US011020293B2

(12) United States Patent
Stryker et al.

(10) Patent No.: US 11,020,293 B2
(45) Date of Patent: Jun. 1, 2021

(54) MULTI-FUNCTION PERSON HANDLING EQUIPMENT

(71) Applicant: Stryker Corporation, Kalamazoo, MI (US)

(72) Inventors: Martin W. Stryker, Kalamazoo, MI (US); Ross Timothy Lucas, Paw Paw, MI (US)

(73) Assignee: Stryker Corporation, Kalamazoo, MI (US)

( * ) Notice: Subject to any disclaimer, the term of this patent is extended or adjusted under 35 U.S.C. 154(b) by 923 days.

(21) Appl. No.: 15/664,610

(22) Filed: Jul. 31, 2017

(65) Prior Publication Data

US 2018/0028377 A1 Feb. 1, 2018

Related U.S. Application Data

(60) Provisional application No. 62/369,417, filed on Aug. 1, 2016.

(51) Int. Cl.
*A61G 1/017* (2006.01)
*A61G 7/16* (2006.01)
(Continued)

(52) U.S. Cl.
CPC ..... *A61G 1/017* (2013.01); *A61G 1/013* (2013.01); *A61G 1/0237* (2013.01); *A61G 1/04* (2013.01);
(Continued)

(58) Field of Classification Search
CPC ..... A61G 1/013; A61G 1/017; A61G 1/0237; A61G 1/0281; A61G 5/006; A61G 5/061;
(Continued)

(56) References Cited

U.S. PATENT DOCUMENTS 2,202,383 A 5/1940 Hymer et al.
2,747,919 A 5/1956 Ferneau et al.
(Continued)

FOREIGN PATENT DOCUMENTS

CA 2481694 A1 10/2003
CN 2548611 Y 5/2003
(Continued)

OTHER PUBLICATIONS

Yanko Design, Caterpillar Stretcher Scoffs Stairs, by Long Tran, dated Aug. 23, 2007.

*Primary Examiner* — Nicholas F Polito
(74) *Attorney, Agent, or Firm* — Warner Norcross + Judd LLP

(57) ABSTRACT

A person handling apparatus includes a deck with a seat section, a leg section, and a back section. The back section is pivotally mounted to the seat section. The leg section has a proximal end pivotally mounted to the seat section and a cantilevered end spaced a first distance from its proximal end. The seat section, the leg section, and the back section are arranged to lie in a common plane when the deck is in a supine configuration to support a person in a supine position. First and second leg assemblies are pivotally mounted to the deck to move between (1) first deployed positions wherein the first and second leg assemblies are angled relative to the deck when the deck is in the supine configuration to support the deck in a raised composition and (2) second deployed positions when the deck is supported in the chair configuration.

25 Claims, 39 Drawing Sheets

(51) Int. Cl.

| | |
|---|---|
| ***A61G 1/013*** | (2006.01) |
| ***A61G 1/02*** | (2006.01) |
| ***A61G 7/10*** | (2006.01) |
| ***A61G 5/06*** | (2006.01) |
| ***A61G 5/00*** | (2006.01) |
| ***A61G 1/04*** | (2006.01) |
| *A61G 1/056* | (2006.01) |

(52) U.S. Cl.
CPC ..... *A61G 5/061* (2013.01); *A61G 5/066* (2013.01); *A61G 7/1013* (2013.01); *A61G 7/1038* (2013.01); *A61G 7/16* (2013.01); *A61G 1/0243* (2013.01); *A61G 1/0562* (2013.01); *A61G 5/006* (2013.01)

(58) Field of Classification Search
CPC ..... A61G 5/066; A61G 7/16; A61G 13/105; A61G 15/002; A61G 1/0243; A61G 1/0562; A61G 1/04; A61G 7/1013; A61G 7/1038
See application file for complete search history.

(56) References Cited

U.S. PATENT DOCUMENTS 3,289,219 A * 12/1966 Ferneau ..... A61G 1/0565 5/626
3,640,566 A * 2/1972 Hodge ..... A61G 5/128 297/68
3,901,356 A 8/1975 Butler
4,037,871 A 7/1977 Bourgraf et al.
4,097,941 A 7/1978 Merkel
4,105,242 A * 8/1978 Terbeek ..... A61G 1/0562 280/30
4,136,888 A * 1/1979 Bowie, Jr. ..... A61G 5/066 280/47.25
4,273,306 A 6/1981 Chang
4,549,720 A 10/1985 Bergenwall
4,691,962 A 9/1987 Holdt
4,717,169 A * 1/1988 Shaffer ..... A47C 17/163 280/648
4,962,941 A 10/1990 Rembos
4,987,620 A 1/1991 Sharon
5,438,723 A 8/1995 Carroll
5,479,666 A 1/1996 Foster et al.
5,537,700 A 7/1996 Way et al.
5,842,237 A 12/1998 Hargest et al.
6,125,485 A 10/2000 Way et al.
6,336,235 B1 1/2002 Ruehl
6,381,781 B1 5/2002 Bourgraf et al.
6,389,623 B1 5/2002 Flynn et al.
6,405,393 B2 6/2002 Megown
6,735,794 B1 5/2004 Way et al.
6,739,004 B1 5/2004 Abrahamsen et al.
6,792,633 B1 9/2004 Ito
6,799,770 B2 10/2004 Patrick et al.
6,920,656 B2 7/2005 Roussy
7,013,510 B1 3/2006 Johnson
7,131,151 B2 11/2006 Ferneau et al.
7,185,377 B2 3/2007 Roussy
7,441,786 B2 10/2008 Stryker et al.
7,520,347 B2 4/2009 Chambliss et al.
7,636,966 B2 12/2009 Gallant et al.
7,637,550 B2 12/2009 Menna
7,757,313 B2 7/2010 Koorey
8,117,696 B2 * 2/2012 Wernqvist ..... A61G 7/16 5/618
8,381,330 B2 2/2013 Roussy
8,640,283 B2 2/2014 Broadley et al.
RE44,884 E 5/2014 Lambarth
8,739,329 B2 6/2014 Koorey
9,107,781 B1 8/2015 Edgerton
9,233,033 B2 1/2016 Valentino
9,351,584 B1 5/2016 Rizzardo et al.
9,579,240 B2 2/2017 Krolick et al.
2004/0187213 A1 9/2004 Wang
2006/0016008 A1 1/2006 Choi et al.
2007/0095581 A1 * 5/2007 Chambliss ..... A61G 5/08 180/8.2
2007/0245488 A1 * 10/2007 Zimbalista ..... A61G 1/0281 5/86.1
2010/0064439 A1 3/2010 Soltani
2010/0170041 A1 7/2010 Heimbrock et al.
2012/0096644 A1 4/2012 Heimbrock
2012/0124746 A1 5/2012 Andrienko
2012/0292883 A1 11/2012 Noonan et al.
2014/0299391 A1 10/2014 Carletti
2015/0313780 A1 11/2015 Valentino et al.
2015/0320625 A1 11/2015 White
2015/0359693 A1 12/2015 Lyon
2016/0136021 A1 5/2016 Roussy et al.
2016/0287454 A1 10/2016 Magill et al.
2016/0374884 A1 12/2016 Blickensderfer et al.
2017/0042749 A1 2/2017 Valentino et al.
2017/0165135 A1 6/2017 Krolick et al.
2017/0165136 A1 6/2017 Krolick et al.
2017/0196740 A1 7/2017 Krolick et al.

FOREIGN PATENT DOCUMENTS

CN 201005885 Y 1/2008
EP 1226803 A1 7/2002
EP 2494889 A1 9/2012
GB 1046444 4/1962
GB 1084020 A 9/1967
WO 9705925 A1 2/1997
WO 9729726 8/1997
WO 9729726 A1 8/1997
WO 0239944 A2 5/2002
WO 02039944 A3 5/2002
WO WO0239944 A2 * 5/2002 ..... A61G 1/0293
WO 2008127089 A1 10/2008
WO 2009114806 A2 9/2009
WO 2011072023 A2 6/2011

* cited by examiner

MULTI-FUNCTION PERSON HANDLING EQUIPMENT

RELATED APPLICATIONS

This application claims the benefit of U.S. Prov. Appl. Ser. No. 62/369,417, filed on Aug. 1, 2016, which is incorporated by reference herein in its entirety.

TECHNICAL FIELD AND BACKGROUND

The present disclosure relates to a person handling equipment for handling a person, for example, when they need to be moved from a supine position to a seated position.

A common challenge in the emergency medical service (EMS) industry is to reduce the stress and strain on EMS personnel when handling people who need assistance. For example, a common situation that can subject EMS personnel to undue stress, and possible injury, is when moving a person from one person handling apparatus, such as an emergency cot, to another person handling apparatus, such as a chair. Further, when dealing with injured people, the time it takes to lift someone, for example, onto a backboard, and then transfer them onto a cot to get them into appropriate transport vehicle may be critical.

Accordingly, there is a need to reduce the stress and strain on EMS personnel when moving a person from one apparatus to another apparatus. Further, there is a need to reduce the time it takes to lift someone up and then get them into appropriate transport.

SUMMARY

Accordingly, a person handling apparatus includes a deck that can be reconfigured between a flat configuration for supporting a person in a supine position and a reclined or seated position.

In one embodiment, a person handling apparatus includes a deck having a seat section, a leg section, and a back section, with the back section pivotally mounted to the seat section. The leg section has a proximal end pivotally mounted to the seat section and a cantilevered, distal end that is spaced from its proximal end. The seat section, the leg section, and the back section are operable to lie in a common plane to define a supine configuration for the deck to support a person in a supine position and to reconfigure to define a chair configuration for the deck to support a person in a seated position. First and second leg assemblies are pivotally mounted to the back section of the deck to move between (1) first deployed positions wherein the first and second leg assemblies are angled relative to the deck when the deck is in the supine configuration to support the deck in a raised composition and (2) second deployed positions when the deck is supported in the chair configuration.

In one aspect, each respective leg assembly includes an actuator to pivot the respective leg assembly.

In another aspect, the first and second leg assemblies each include a pair of legs.

Optionally, each of the leg assemblies includes a pair of wheels.

In yet a further aspect, the first leg assembly is an articulatable leg assembly and is pivotally mounted to the back section at a first pivot connection. The articulatable leg assembly includes a hinge spaced from the first pivot connection wherein the first leg assembly is foldable about the hinge.

According to other aspects, the seat section has a seat section length. The first leg assembly has an upper portion above the hinge and a lower portion below the hinge. The hinge is spaced from the first pivot connection approximately equal to the seat section length wherein when the first leg assembly is folded about the hinge, the lower portion of the first leg assembly is positionable to extend alongside the leg section to define the second deployed position when the deck is folded into the chair configuration. Further, the upper portion of the first leg assembly is positionable to extend alongside the seat section.

In another aspect, the leg section has a leg section length. The lower portion of the first leg assembly has a lower portion length approximately equal to or greater than the leg section length. In this manner, when the first leg assembly is moved to the second deployed position, the leg section of the deck may be moved to a vertical orientation without interfering with the floor surface.

In yet a further aspect, the first leg assembly includes a first pivot connection actuator wherein the first pivot connection actuator pivots the first leg assembly about the first pivot connection. Optionally, the first pivot connection actuator may comprise an electric actuator, a pneumatic actuator, a hydraulic actuator, or a manual mechanical actuator.

According to other aspects, the first leg assembly includes a hinge actuator at the hinge to fold the first leg assembly about the hinge. Optionally, the hinge actuator includes a motor and a gear.

In another aspect, the second leg assembly is pivotally mounted to the back section by a translatable pivot connection. In a further aspect, the second leg assembly includes a translatable pivot connection actuator. The translatable pivot connection actuator pivots the second leg assembly about the translatable pivot connection. In one embodiment, the translatable pivot connection actuator includes a motor and a gear.

In another aspect, the second leg assembly includes a stair climbing track. Optionally, the stair climbing track has a length sufficient to span three steps of a stairway. In yet another aspect, the stair climbing track is a powered stair climbing track.

In a further aspect, the stair climbing track is pivotally mounted to the person handling apparatus wherein the stair climbing track can be moved from a deployed position to a stowed position.

According to other aspects, the second leg assembly includes a pair of legs with the stair climbing track pivotally mounted between the legs.

In another aspect, the translatable pivot connection includes an actuator to move the translatable pivot connection along the back section. In one embodiment, the actuator comprises a linear actuator, such as a screw drive.

In yet another aspect, the leg assembly includes one or more wheels. In a further aspect, the one or more wheels of the first leg assembly include caster wheels, with each caster wheel having a swivel axis. In yet a further aspect, the swivel axis is maintained in a vertical orientation regardless of the position of the leg assembly.

According to other aspects, the person handling apparatus further includes a back actuator to pivot the back section relative to the seat section. Optionally, the back actuator includes a powered actuator, such as a motor and gear.

In yet another aspect, the person handling apparatus further includes a leg actuator to pivot the leg section relative to the seat section. Optionally, the leg actuator includes a powered actuator, such as a motor and gear.

In another aspect, the person handling apparatus further includes a foot section mounted to the leg section.

In yet another aspect, the person handling apparatus further includes a handle mounted to the back section.

In another embodiment, a person handling apparatus includes a deck having a seat section, a leg section, and a back section, with the back section being pivotally mounted to the seat section. The leg section has a proximal end pivotally mounted to the seat section and a cantilevered distal end spaced from the proximal end. The seat section, the leg section, and the back section are operable to align to define a supine configuration for the deck to support a person in a supine position and to pivot to define a chair configuration for the deck to support a person in a seated position. First and second leg assemblies are pivotally mounted to the back section of the deck to move between (1) folded positions wherein the first and second leg assemblies generally lie in a common plane with the deck when the deck is in the supine configuration, (2) first deployed positions wherein the first and second leg assemblies are angled relative to the deck when the deck is in the supine configuration to thereby raise the deck, and (3) second deployed positions wherein the deck is supported in the chair configuration.

In one aspect, the person handling apparatus further includes a stair climbing track. Optionally, the stair climbing track has a length sufficient to span three steps of a stairway.

In a further aspect, the second leg assembly is pivotally mounted to the back section by a translatable pivot connection. The second leg assembly is moved alongside the back section when moved to the second deployed position. The stair climbing track is pivotally mounted in the second leg assembly wherein the stair climbing track can be moved from a stowed position in the second leg assembly to a deployed position extending from the second leg assembly.

In other aspects, the second leg assembly includes a pair of legs with the stair climbing track pivotally mounted between the legs.

In another aspect, each leg assembly includes one or more wheels.

In a further aspect, the one or more wheels include caster wheels. Each caster wheel has a swivel axis that includes a mechanism to maintain the swivel axis of each caster wheel in a generally vertical direction when in the first deployed position or the second deployed position.

According to other aspects, the person handling apparatus further includes an actuator. The actuator pivots (1) the leg section relative to the seat section, (2) the back section relative to the seat section, or (3) one or more of the leg assemblies.

In other aspects, the first and second leg assemblies are configured to support the deck at a cot height when the deck is in the supine configuration and the first and second leg assemblies are moved to their first deployed positions, and to support the deck at a chair height when the first and second leg assemblies are moved to their second deployed positions and the deck is in the chair configuration.

In another embodiment, a person handling apparatus includes a deck and first and second track assemblies mounted relative to the deck. Each track assembly is mounted independently of the other track assembly so that each track assembly can be independently positioned to engage surfaces having different orientations.

In one aspect, at least one of the track assemblies is mounted to the deck by a wheeled leg assembly. Optionally, each track assembly is mounted to the deck by a wheeled leg assembly.

For example, one or both wheeled leg assemblies may comprise articulating wheeled leg assemblies. Each wheeled leg assembly has an upper leg portion pivotally mounted to the deck and a wheeled lower leg portion pivotally mounted to its upper leg portion. Each track assembly is then mounted to the lower leg portion of its respective leg assembly.

In one aspect, the track assemblies each have a longitudinal extent greater than the longitudinal extent of its respective lower leg portion.

In another aspect, each track assembly is fixedly mounted to the lower leg portion of its respective leg assembly and articulates with its lower leg portion. Alternately, each track assembly may be mounted so that it articulates relative to the lower leg portion of its respective leg assembly.

In one embodiment, the track assemblies comprise powered track assemblies.

In another embodiment, the leg assemblies are pivotally mounted to the deck to move to folded positions wherein the lower leg portions of the leg assemblies generally lie in a common plane with each other and the track assemblies lie in a common plane with each other, both of which lie generally parallel to at least a portion of the deck. Optionally, the leg assemblies are movable to first deployed positions wherein the upper leg portions of each leg assembly are angled at an acute angle relative to the deck to thereby raise the deck to an intermediate position. Further, one or more of the leg assemblies may be movable to second deployed positions wherein the leg assembly is fully extended such that its upper and lower leg portions are aligned along a common longitudinal axis, which forms an obtuse angle with respect to the deck.

According to other aspects, the deck includes at least one articulatable section, such as an articulatable back section, and an actuator. The actuator pivots (1) the back section or (2) one or more of the leg assemblies.

These and other advantages and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE DRAWINGS

Figure 30:
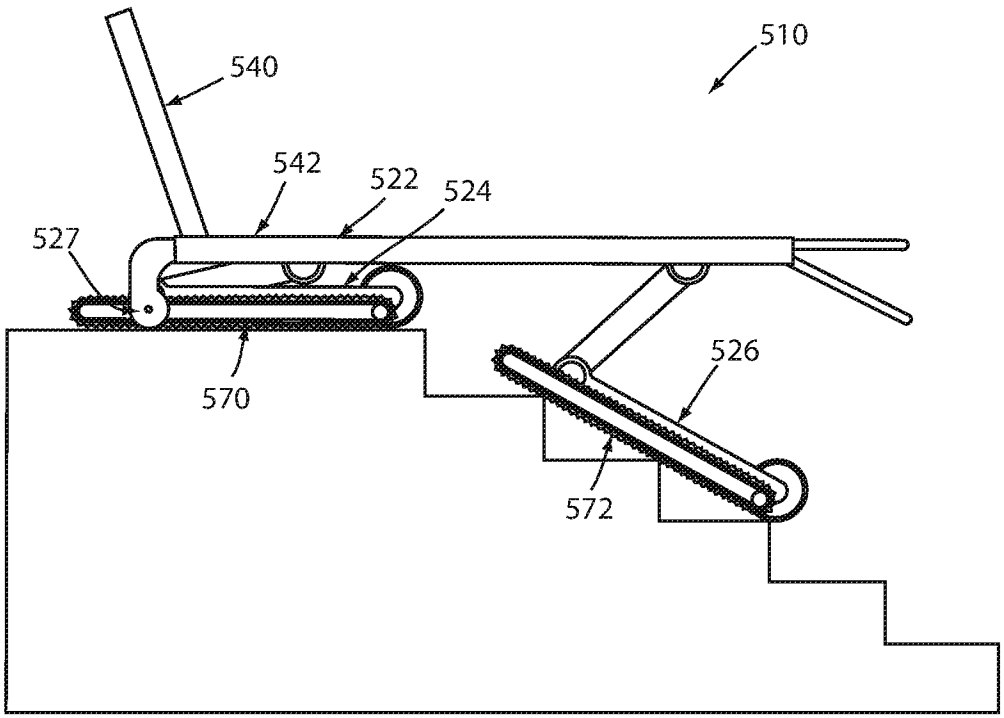
FIG. 30 is a side elevation view of the person handling apparatus positioned in a lowered position, such as its fully lowered position, at the top of a flight of stairs with the foot-end leg assembly and tracks partially unfolded and positioned to engage the steps of the stairs.
Figure 31:
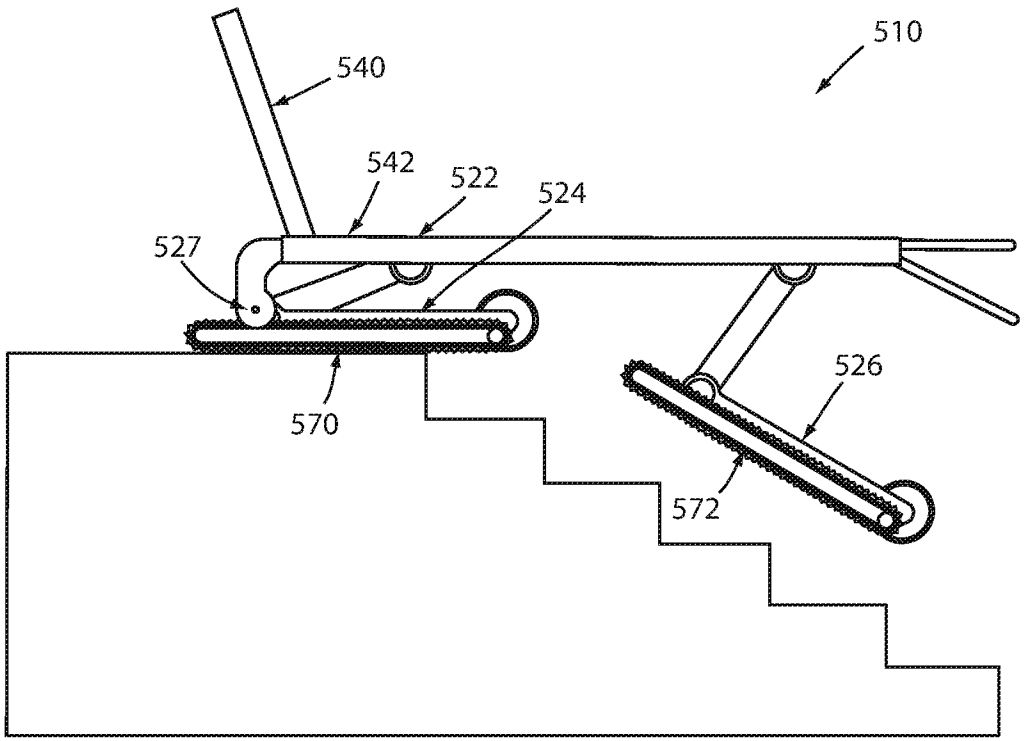
Figure 31A:
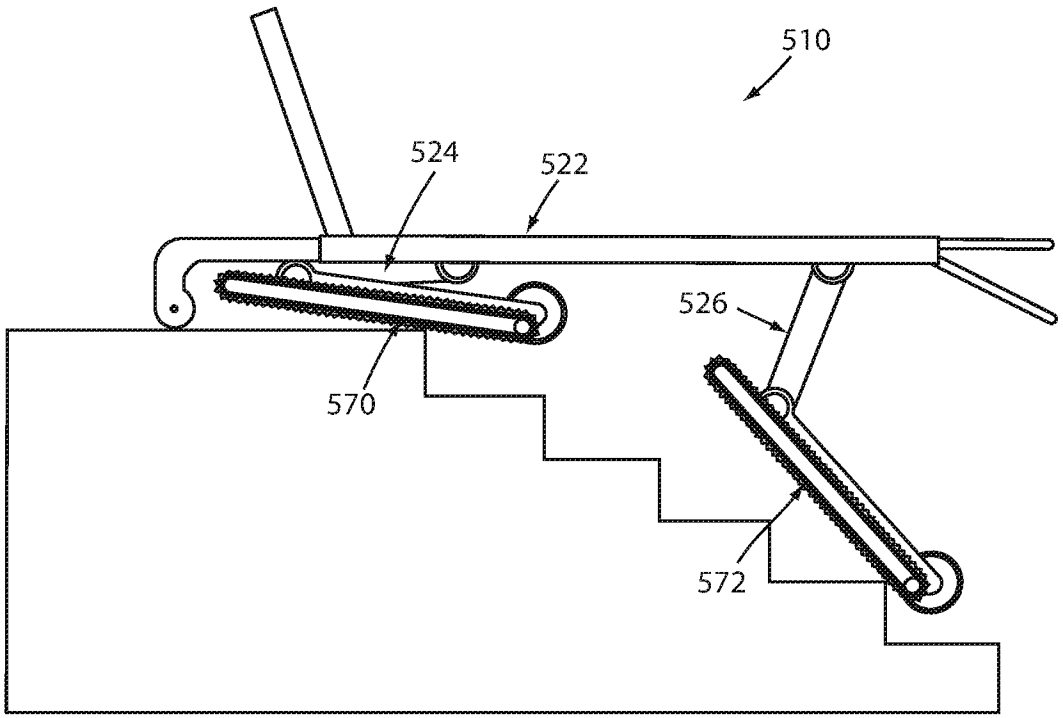
Figure 31B:
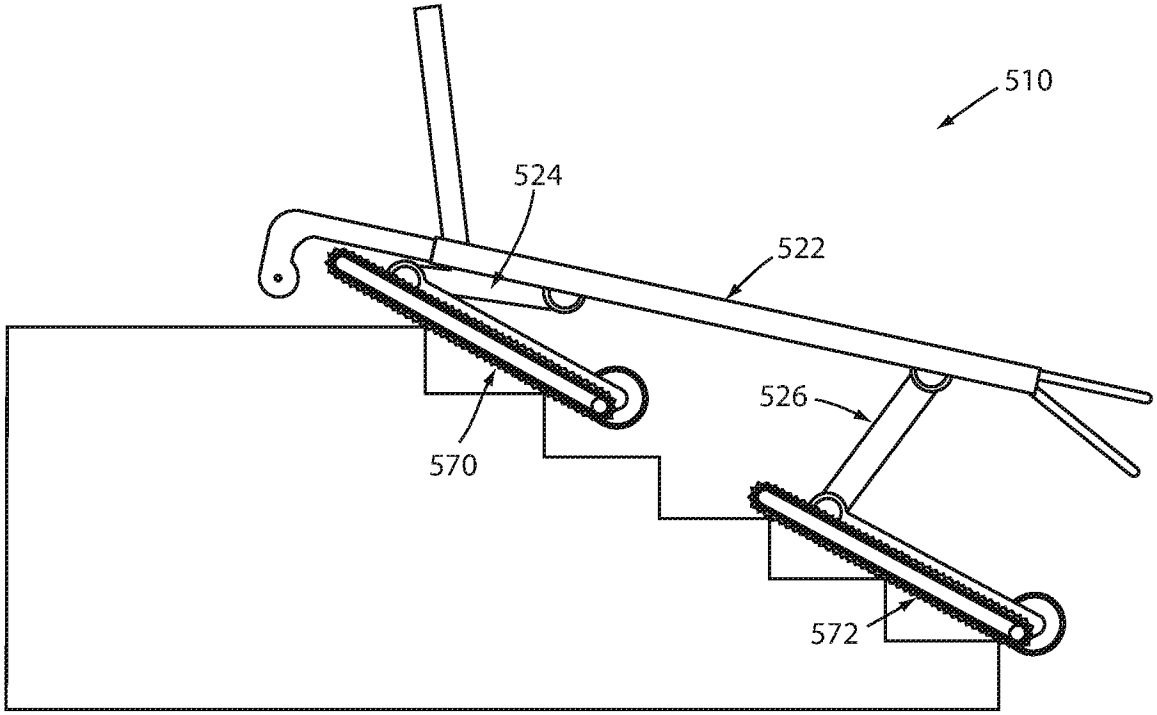
Figure 32:
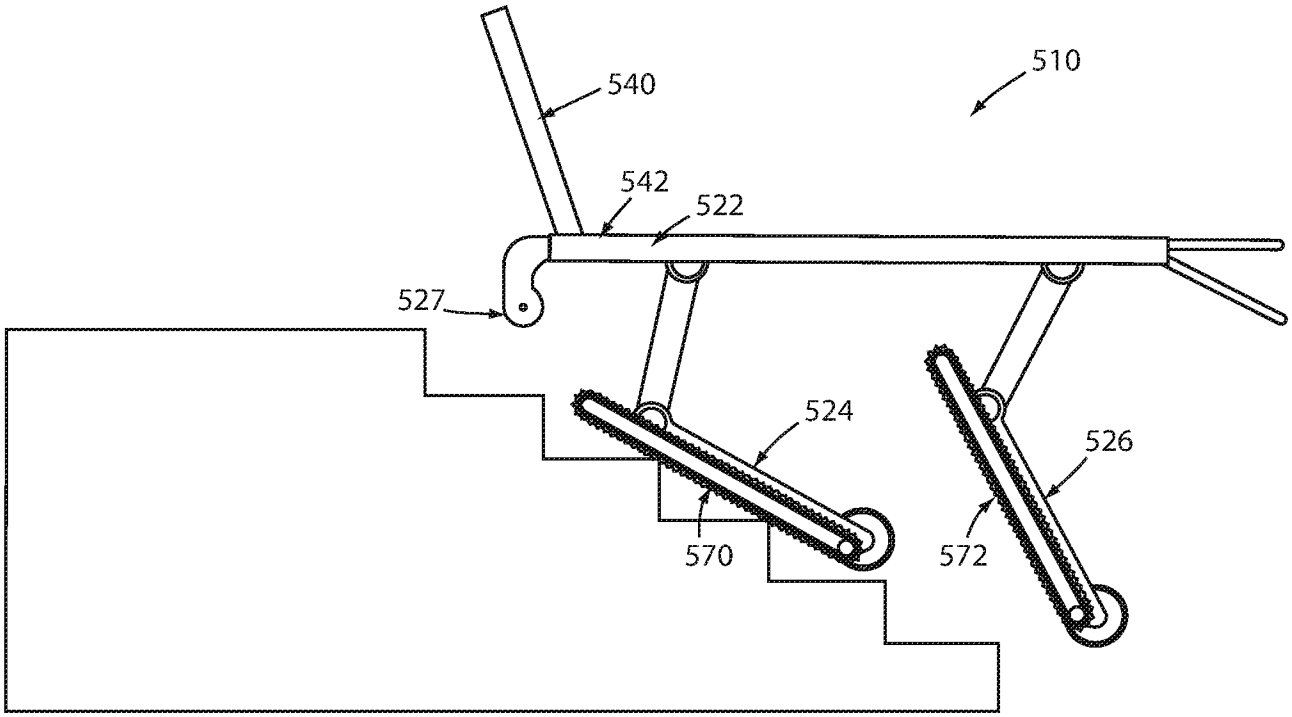
Figure 32A:
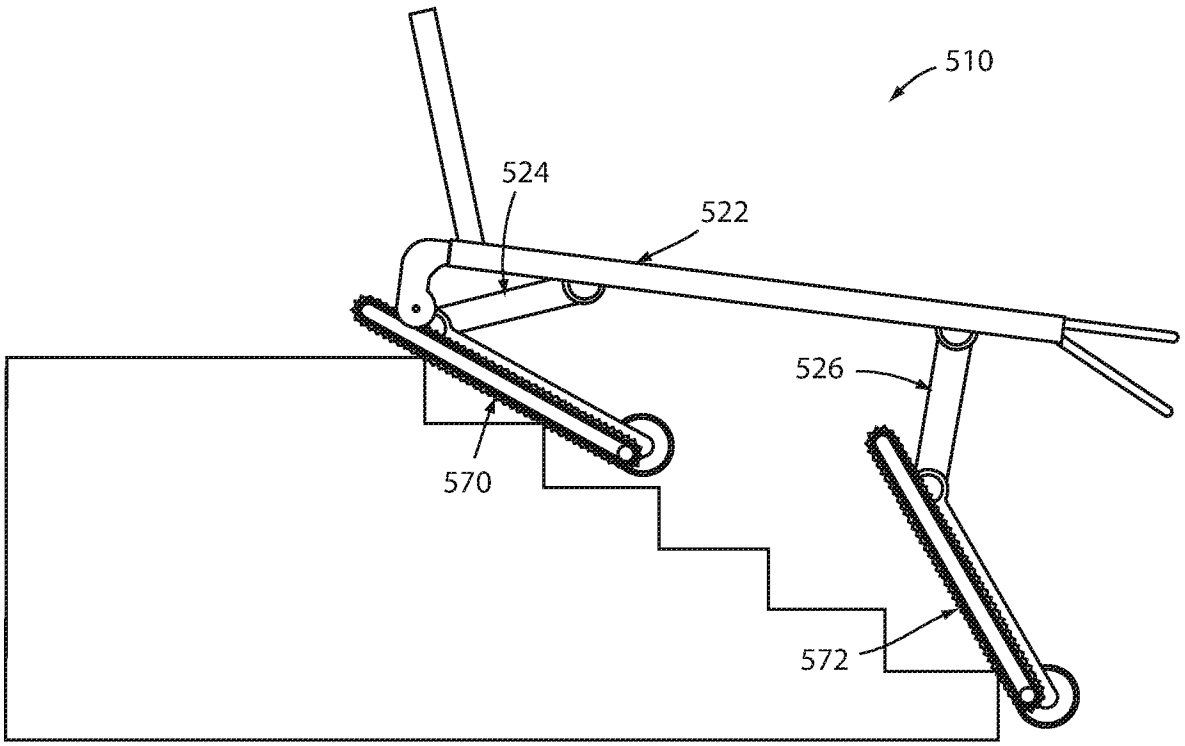
Figure 33:
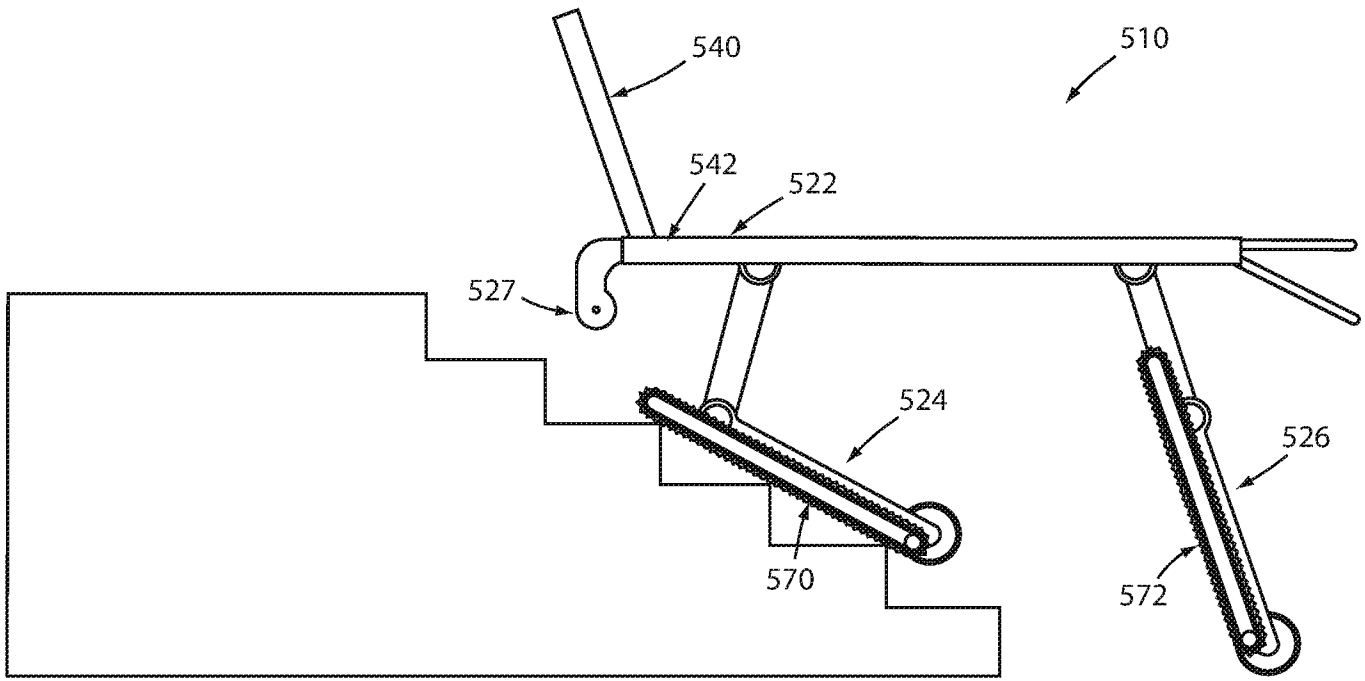
Figure 34:
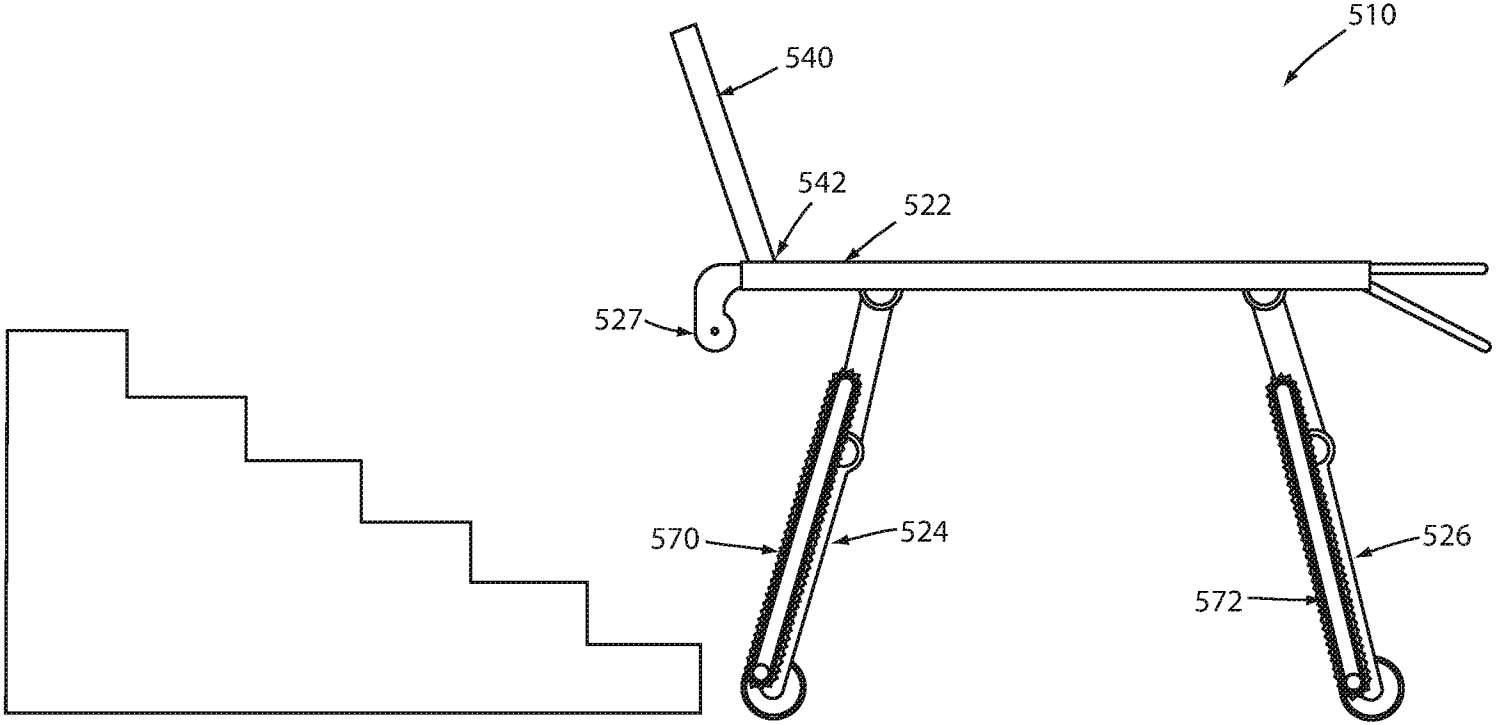

FIG. 31 a similar view to FIG. 30 illustrating the head-end leg assembly and track extended over the top step;

FIG. 31A a similar view to FIG. 31 illustrating the head-end leg assembly and track extended over the top step and the foot-end leg assembly and track engaged with at least one of the steps;

FIG. 31B a similar view to FIG. 31A illustrating both leg assemblies and tracks extended and engaged with the steps of the stairs;

FIG. 32 a similar view to FIG. 31 illustrating the head-end leg assembly and track extended to engage the steps of the stairs and the foot-end leg assembly and track partially unfolded ready for engagement with the floor at the bottom of the stairs;

FIG. 32A a similar view to FIG. 32 illustrating the foot-end leg assembly and track partially unfolded for engagement with the floor at the bottom of the stairs;

FIG. 33 a similar view to FIG. 32 illustrating the head-end track engaging the steps of the stairs with the foot-end leg assembly and track extended so that the leg assembly wheel(s) engage the floor at the bottom of the stairs; and FIG. 34 a similar view to FIG. 33 illustrating both legs extended with their wheels engaging the floor at the end of the stairs.

DETAILED DESCRIPTION

Figure 1:
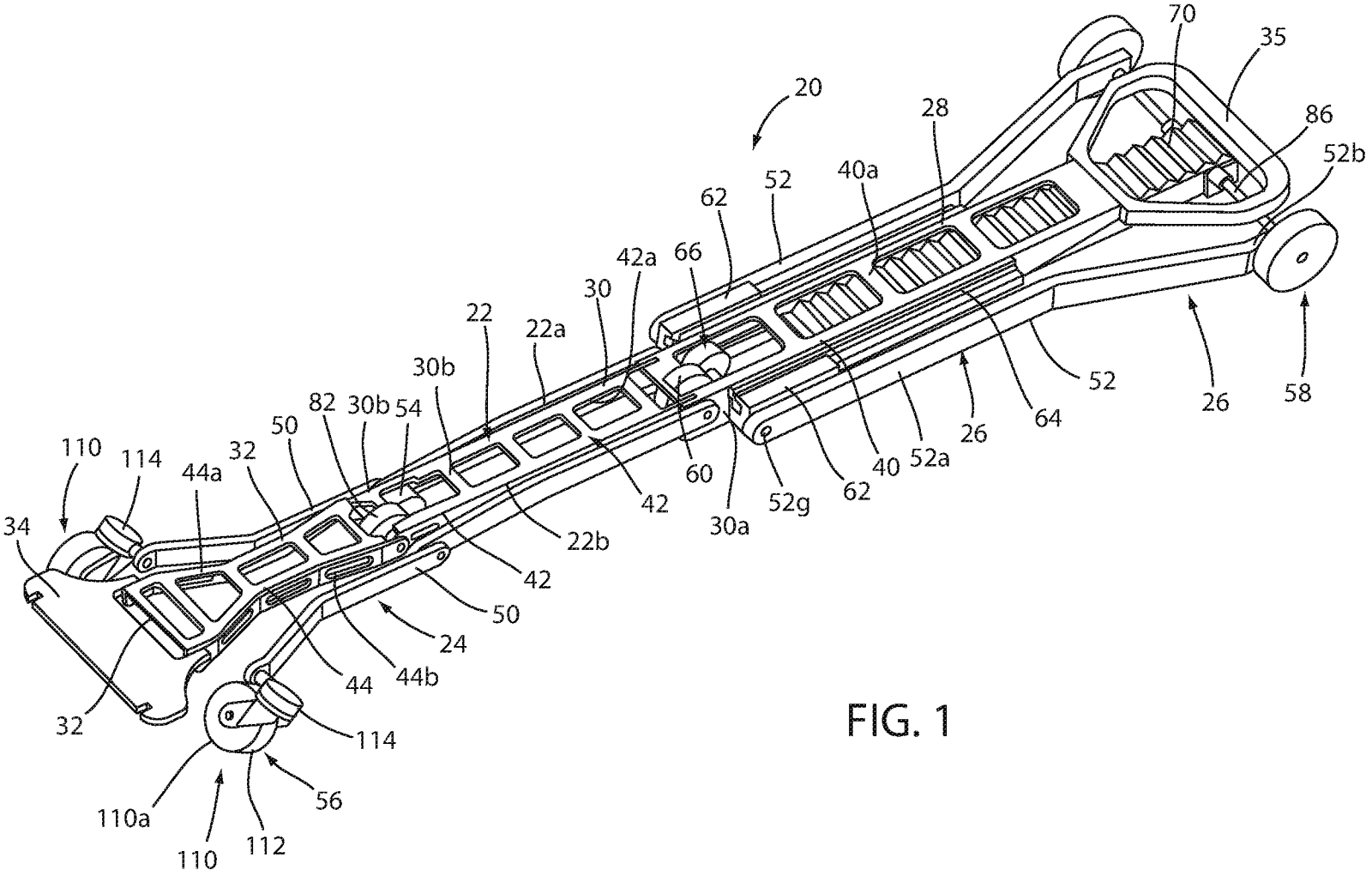
FIG. 1 is a perspective view of a person handling apparatus shown in supine configuration in a fully lowered position.

Referring to FIG. 1, the numeral 20 generally designates a person handling apparatus. As will be more fully described below, person handling apparatus 20 includes a deck that can be reconfigured between a flat or generally planar configuration, for supporting a person in a supine position, and a reclined or seated position so that the person need not be transferred to another apparatus for handling, for example, in an emergency situation. Further, the deck can be raised or lowered as needed, from a low height where the deck is just above a floor surface, for example, in a range of 2 inches to 6 inches, optionally 3 inches to 5 inches, and optionally about 4 inches, to a raised position corresponding to a conventional cot height suitable for loading into an emergency vehicle, or anywhere in between.

As best seen in FIG. 1, person handling apparatus 20 includes a deck 22 and first and second leg assemblies 24 and 26. Deck 22 comprises an articulatable deck with a plurality of deck sections, namely a back section 28, a seat section 30, and a leg section 32, with the back section 28 and leg section 32 pivotally mounted to opposed ends 30*a* and 30*b* of seat section 30. In the illustrated embodiment, deck 22 is formed from deck sections (28, 30, and 32) that are within the footprint of leg assemblies 24, 26 and, therefore, form a "spine deck", with the leg assemblies 24, 26 mounted to the lateral sides 22*a* of the deck 22. Alternately, deck 22 may comprise an exterior deck, where at least a portion of the legs of the leg assemblies 24, 26 are within the footprint of the deck sections. Additionally, while deck 22 itself can be used as a backboard, deck 22 may be configured to couple to a separate backboard, such as described in U.S. Prov. Pat. Appl. entitled EMS BACKBOARD, filed by Stryker Corporation on Aug. 1, 2016, which is hereby incorporated by reference in its entirety.

Further, in addition to back section 28, seat section 30, and leg section 32, deck 22 optionally includes a foot section 34. In one embodiment, foot section 34 is mounted to the cantilevered distal end 32*a* of leg section 32, whereas the proximal end 32*b* of leg section 32 is pivotally mounted to end 30*b* of seat section 30. For example, foot section 34 may comprise a plate that is pivotally mounted to the distal end 32*a* of leg section 32 by pivot shafts 34*b* (FIG. 3), which may include a detent mechanism to define certain predefined positions for foot section 34, such as in the same plane as sections 28, 30, and 32 when in the supine configuration or angled upwardly when deck 22 is in its chair or reclined configurations.

Further, deck 22 may optionally include a handle 35, formed from a loop structure 35*a*, which is secured to the distal end of back section 28. Handle 35 can facilitate the transport of apparatus 20, especially in emergency situations. Further, handle 35 may be used as a mounting surface for mounting accessories, as well as the control unit described below.

Figure 9:
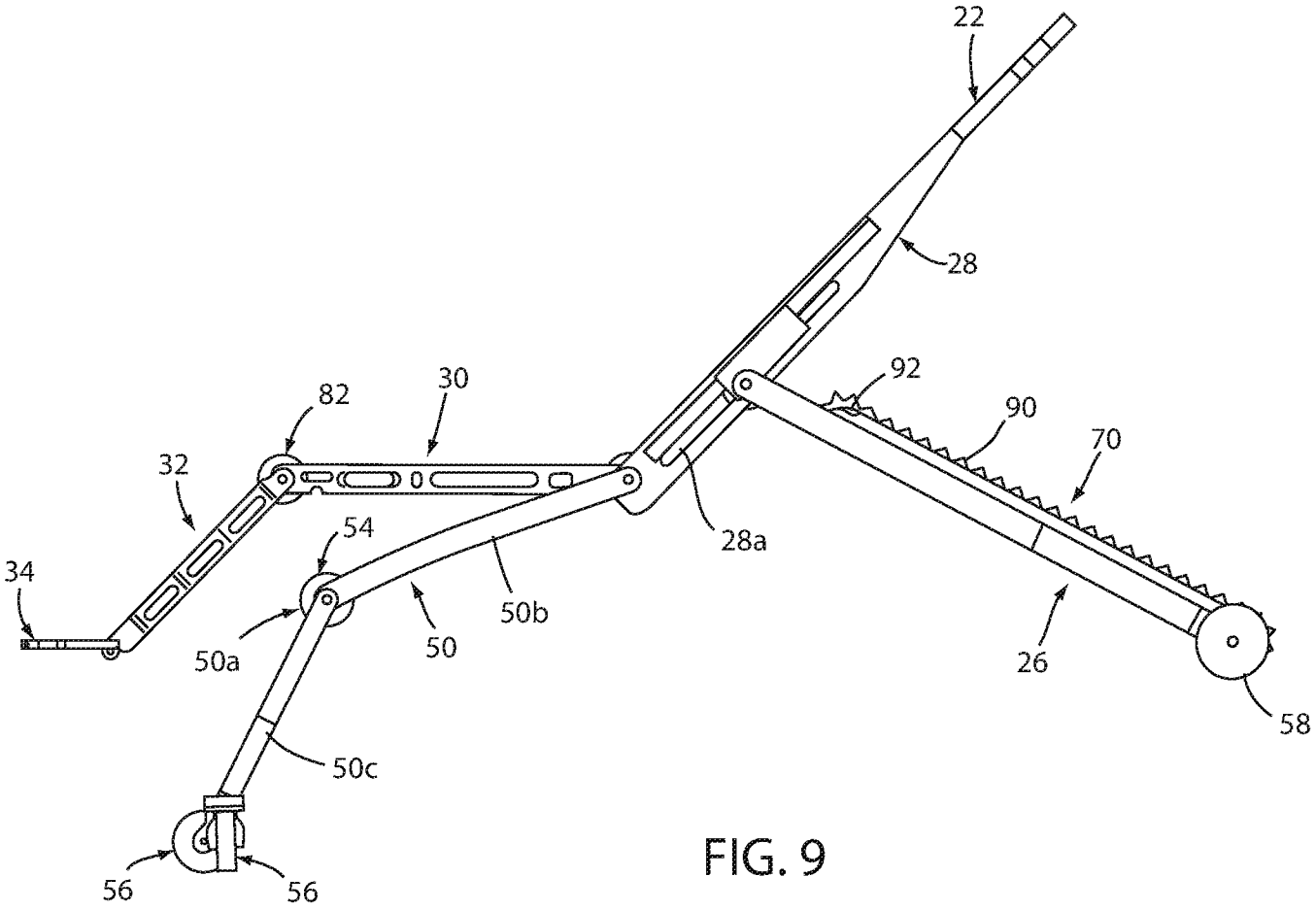
FIG. 9 is a side elevation view of the person handling apparatus illustrating the person handling apparatus is a reclined chair configuration.
Figure 10:
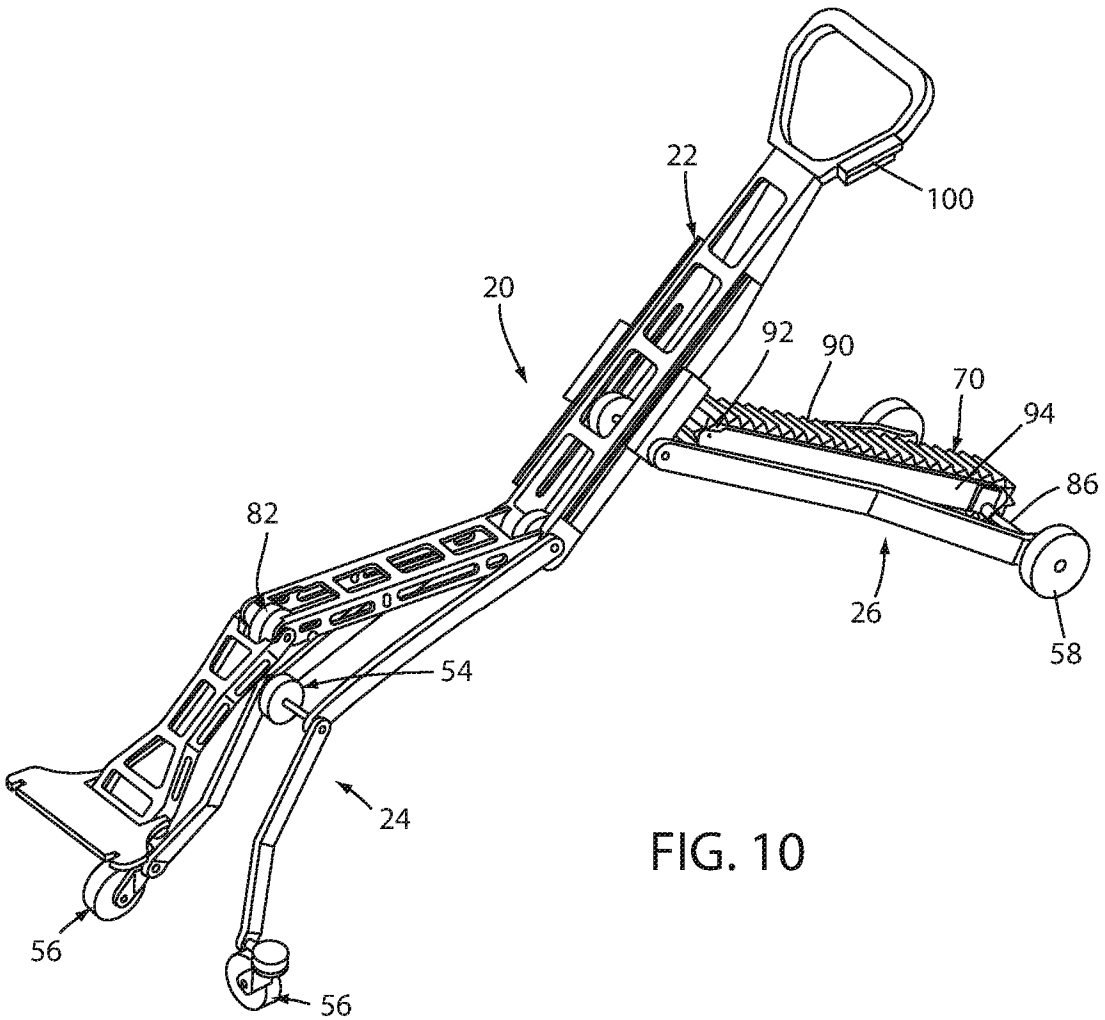
FIG. 10 is a perspective view of the person handling apparatus of FIG. 9.
Figure 11:
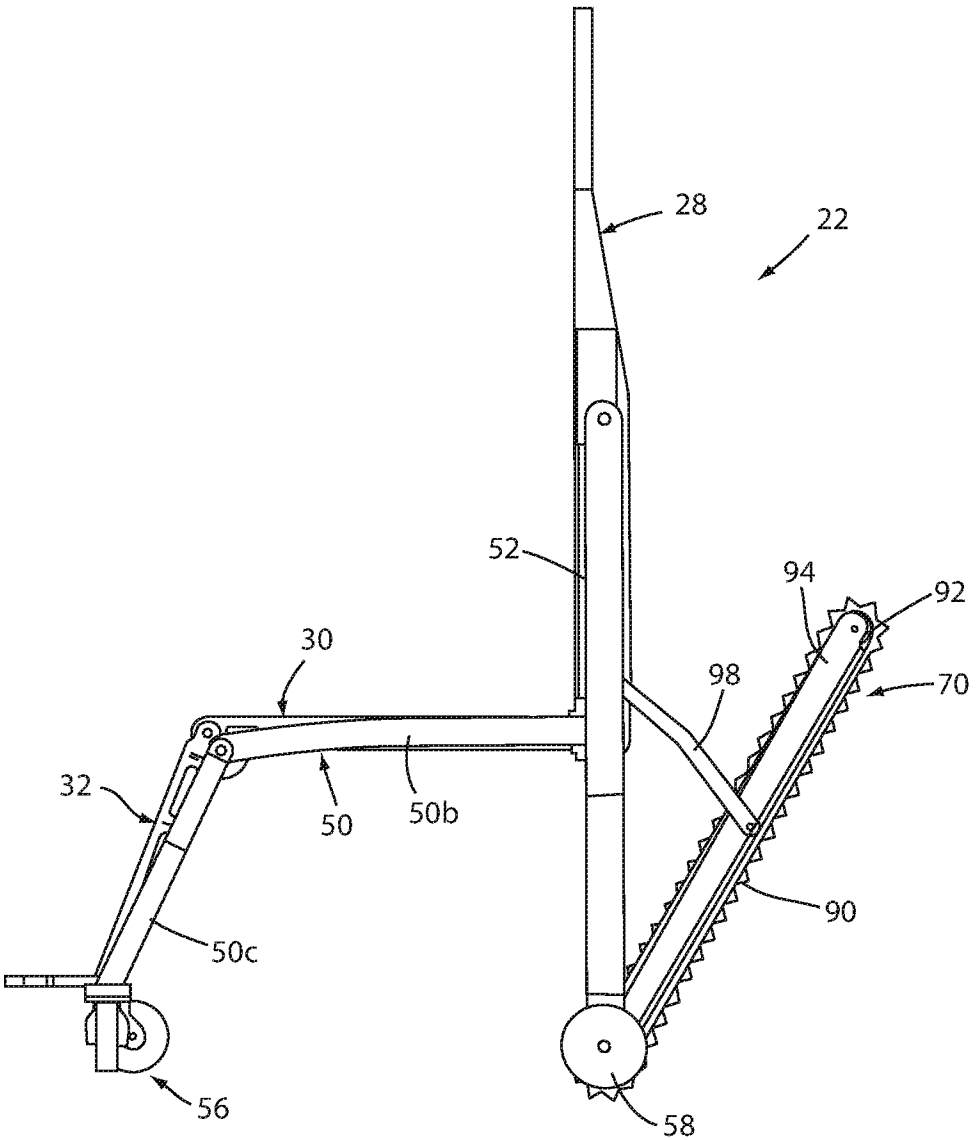
FIG. 11 is a side elevation view of the person handling apparatus illustrating the person handling apparatus is a stair chair configuration.
Figure 12:
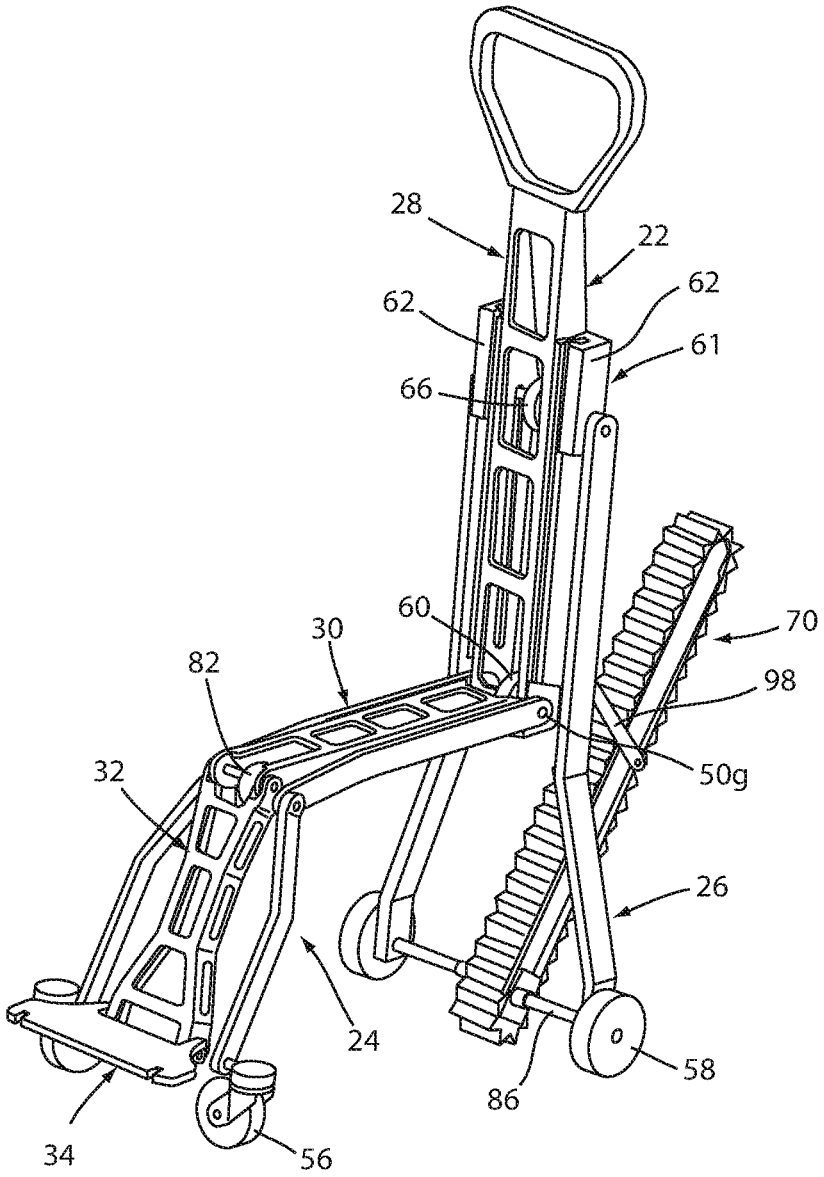
FIG. 12 is a perspective view of the person handling apparatus of FIG. 11.

Referring again to FIG. 1, back section 28, seat section 30, and leg section 32 are pivotally joined together, as noted, and may be arranged to generally lie in a common plane (supine configuration) so that deck 22 can be used as a cot and support a person in a supine position. Further, back section 28 may be raised to raise the head-end of the deck 22. Deck sections 28, 30, and 32 may also be reconfigured into a plurality of different configurations, including a reclined configuration, such as shown in FIGS. 9 and 10, and a chair configuration, such as shown in FIGS. 11 and 12. The term "reclined configuration" refers to when the back section is tilted up from the supine configuration, but not fully up like in the chair configuration. Therefore, it should be understood that the reclined configuration may include the deck raised high enough but with back section raised low enough to allow transfer to or from a flat surface, such as a table. Reclined configuration also may include the deck at or near a chair height and with the back section high enough to allow transfer to or from a chair, including a bed or stretcher in a chair configuration. Further, as will be more fully described below, deck sections 28, 30, and 32 may be reconfigured, essentially, into an infinite number of configurations between the supine configuration and a vertical or near vertical position, such as shown in FIG. 13.

Figure 13:
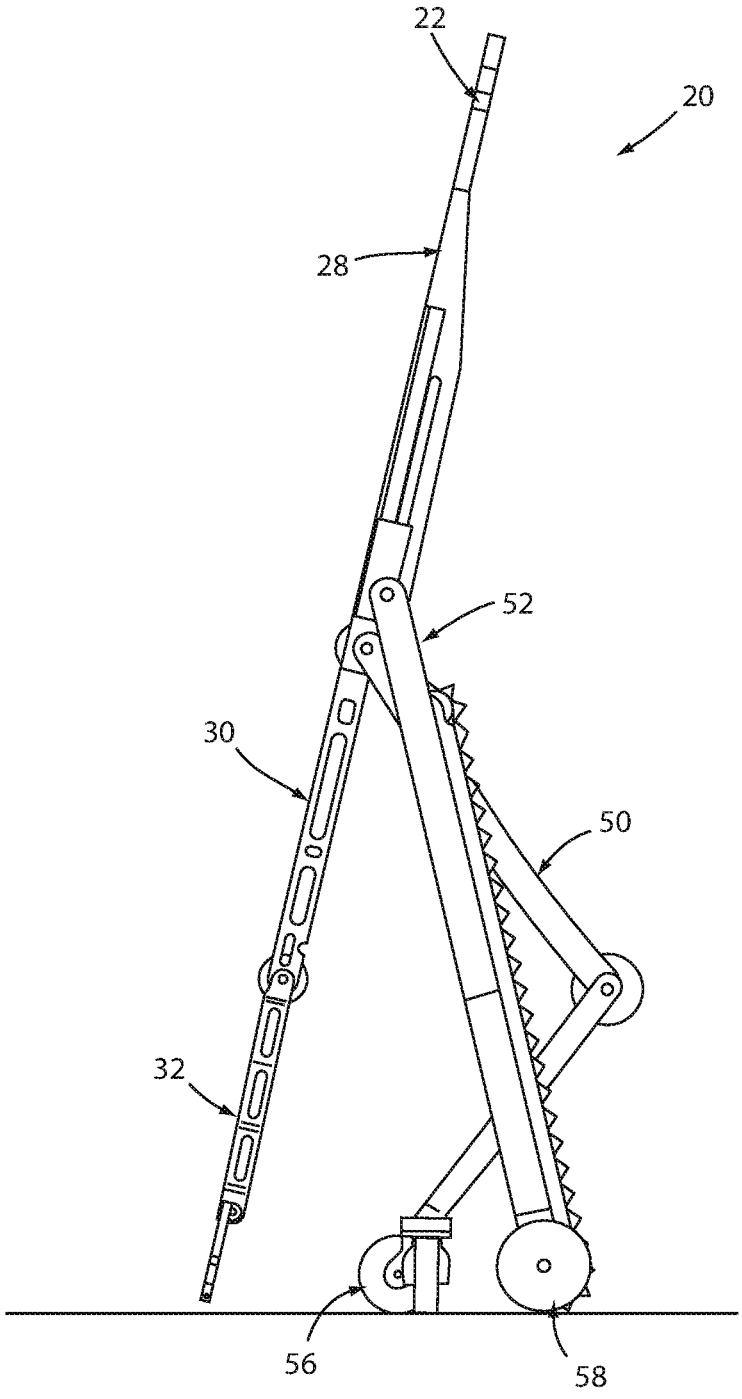
FIG. 13 is a side elevation view of a vertical or near vertical orientation of the person handling apparatus.
Figure 14:
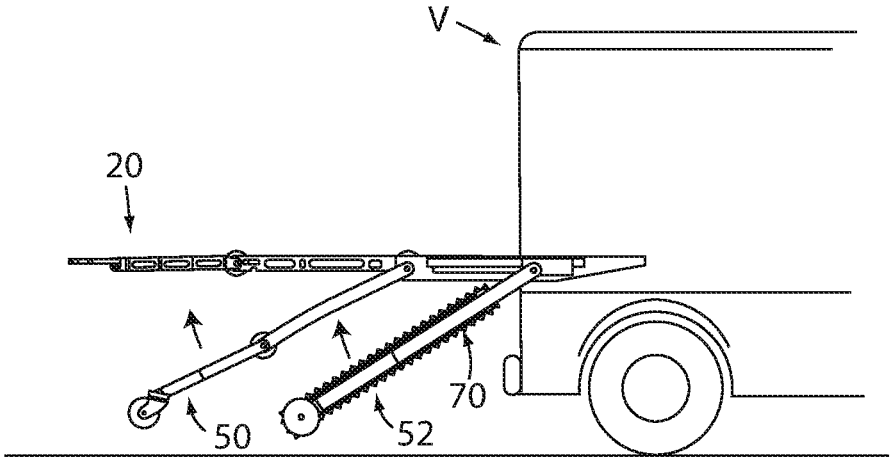
FIG. 14 is a side elevation view of illustrating the person handling apparatus in a loading configuration.
Figure 15:
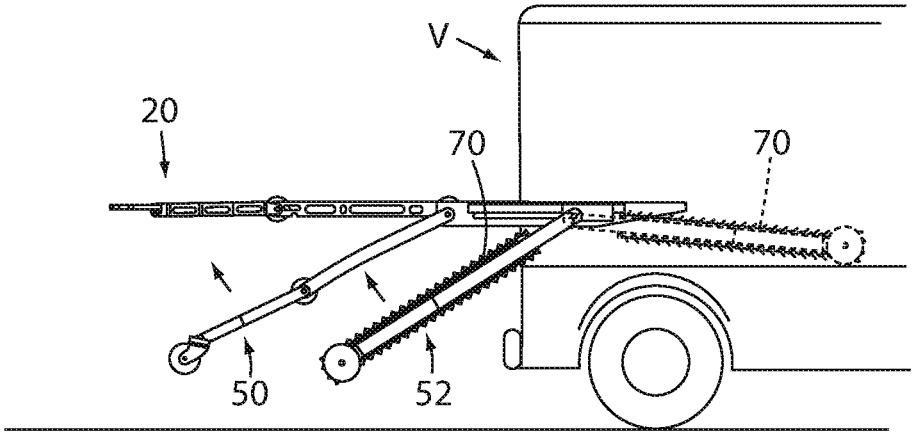
FIG. 15 is a side elevation view of the person handling apparatus being loaded into the rear opening of an emergency vehicle.
Figure 16:
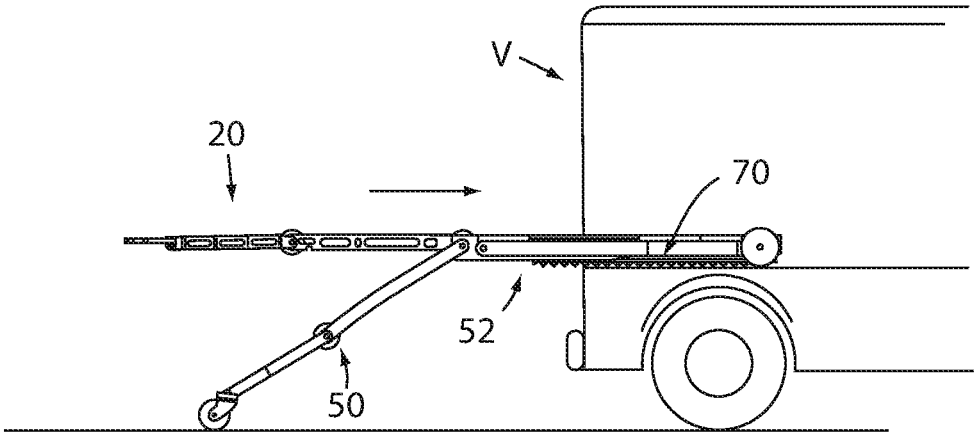
FIG. 16 is a side elevation view of the person handling apparatus in a second loading configuration.

Leg assemblies 24 and 26 are pivotally mounted to a deck 22 to raise deck 22 between a fully lowered position (FIGS. 1 and 2) and one or more raised positions (FIGS. 3-12) and a vertical or near vertical position (FIG. 13). Further, as will be more full described below, leg assemblies 24 and 26 and deck sections 28, 30, 32, and 34 may be configured to provide, in essence, an infinite number of configurations, including a fully lowered supine configuration (FIGS. 1 and 2), raised cot configurations (FIGS. 3-8), reclined configurations (such as illustrated in FIGS. 9 and 10), chair configurations (FIGS. 11-12); vertical or near vertical configurations (such as illustrated in FIG. 13), and various loading configurations (such as shown in FIGS. 14-16).

In the illustrated embodiment, each deck section 28, 30, and 32 may be formed from an inverted channel shaped member 40, 42, 44, optionally with perforated upper webs 40*a*, 42*a*, 44*a*, respectively, to reduce the weight of apparatus 20, and further perforated, downwardly depending flanges 40*b*, 42*b*, and 44*b*, with flanges 40*b*, 42*b*, and 44*b* together forming the lateral sides of deck 22. Alternately, as noted below, one or more of the deck sections 28, 30, 32 or foot section 34, maybe formed from panels, such as honeycomb or corrugated plastic or metal, such as aluminum, panels. Optionally, leg section 32 may have a split construction to allow one side of the leg section 32 to remain raised, while the other side of leg section 32 to be lowered. For example, this might be suitable in the case of a person that has an injured leg that cannot bend.

Leg assemblies 24, 26 each include a pair of legs 50, 52, respectively. As noted above, leg assemblies 24 and 26 are mounted to the lateral sides 22*a* of deck 22. In the illustrated embodiment, legs 50, 52 are pivotally mounted to the opposed lateral sides of deck 22 and, more specifically, to flanges 40*b* of back section 28.

Figure 4:
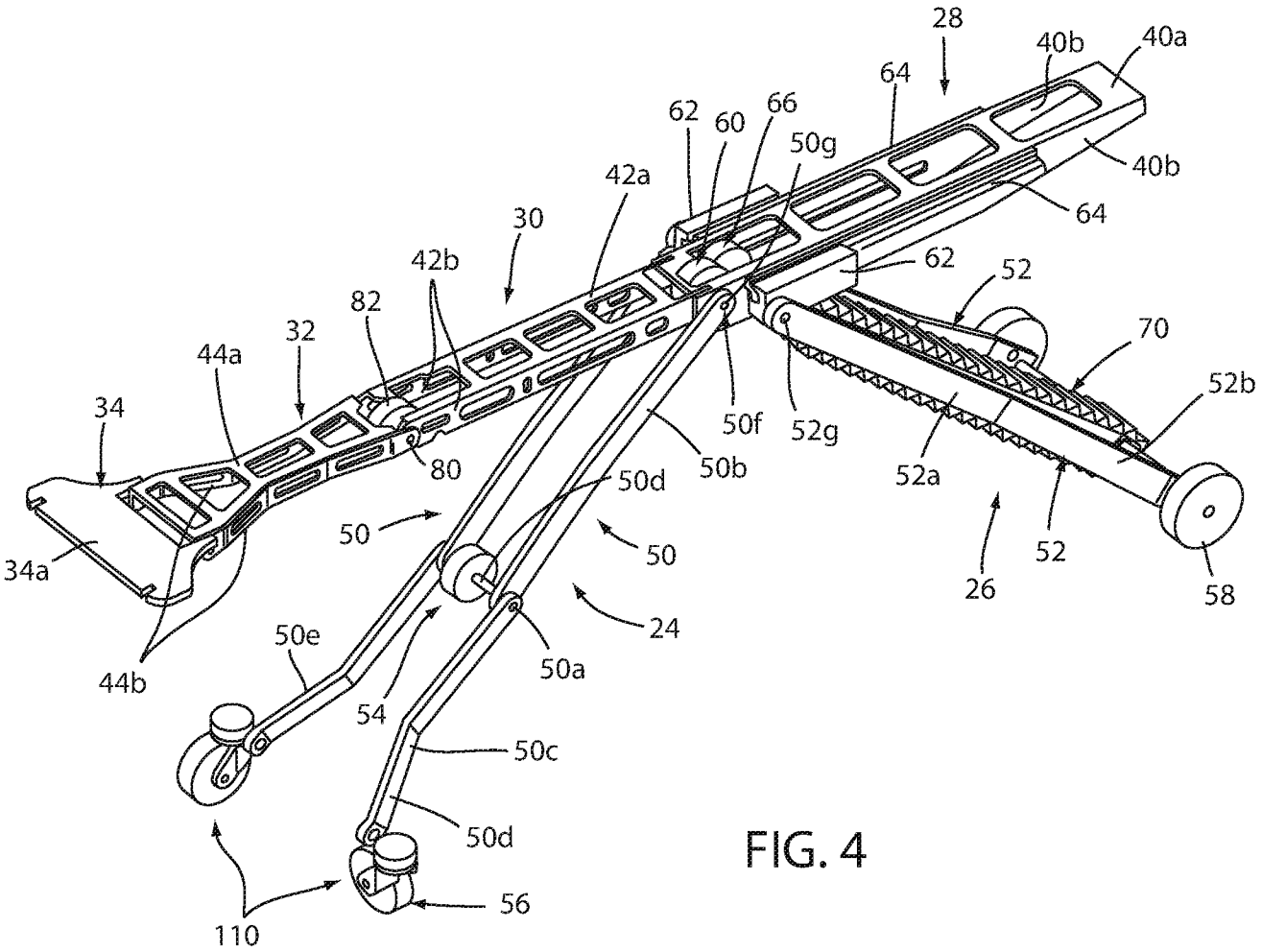
FIG. 4 is a perspective view of the person handling apparatus of FIG. 3.

As best seen in FIG. 4, each leg 50 comprises an articulating leg with a hinge 50*a* that joins the upper leg portion 50*b* of leg 50 with the lower leg portion 50*c* of leg 50. Further, hinges 50*a* may be formed by a pivot shaft 50*d* that extends between both legs (and is fixed to lower leg portions 50*c* and journaled in upper leg portions 50*b*) to form a common pivot connection or hinge for both legs 50, so that lower leg portions pivot about hinge 50*a* together and legs 50 move in unison. In the illustrated embodiment, upper leg portions 50*b* are linear and generally parallel, whereas lower leg portions 50*c* have diverging portions 50*e* to provide a wider footprint at the lower end of leg assembly 24.

Optionally, hinge 50*a* includes an actuator 54. In the illustrated embodiment, hinge 50*a* includes a single actuator; however, it should be understood that more than one actuator may be provided. Suitable actuators include electrical, pneumatic, hydraulic, or manual mechanical actuators. In the illustrated embodiment, the actuator is a motor and rotary gear, which is mounted about the pivot shaft and is driven by its corresponding motor, which is fixedly mounted to upper leg portion 50*b*. In this manner, hinge 50*a* may be powered and, further, controlled either locally or remotely, as described below. Furthermore, by using a motor and gear arrangement for the actuator, the angular orientation of lower leg portions 50*c* may be controlled by simply stopping the motor, which means that lower leg portions 50*c* may be positioned, in essence, in an infinite number of positions.

Similarly upper leg portions 50*b* may be pivotally mounted to back section 28 by a pivot connection 50*f* formed by a common pivot shaft 50*g*, which is journaled in flanges 40*b* of back section 28 and fixedly mounted to the upper ends of legs 50. Further, leg assembly 24 may include a second actuator 60 to pivot leg assembly 24 about pivot connection 50*f*. Similar to actuator 54, suitable actuators include a motor and rotary gear. In this manner, pivot connection 50*f* may be powered and, further, controlled either locally or remotely.

Figure 2:
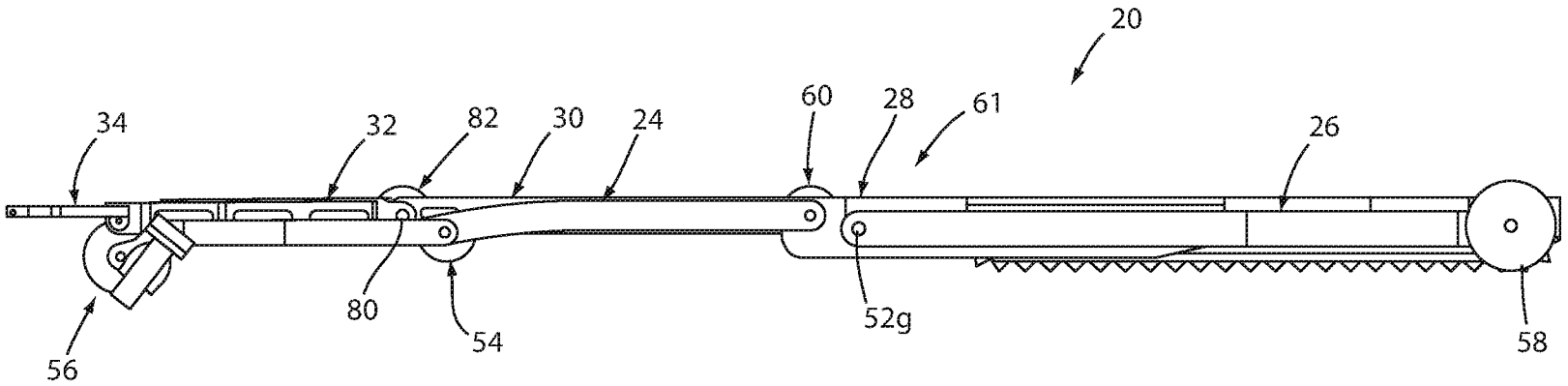
FIG. 2 is a side elevation view of the person handling apparatus of FIG. 1.
Figure 3:
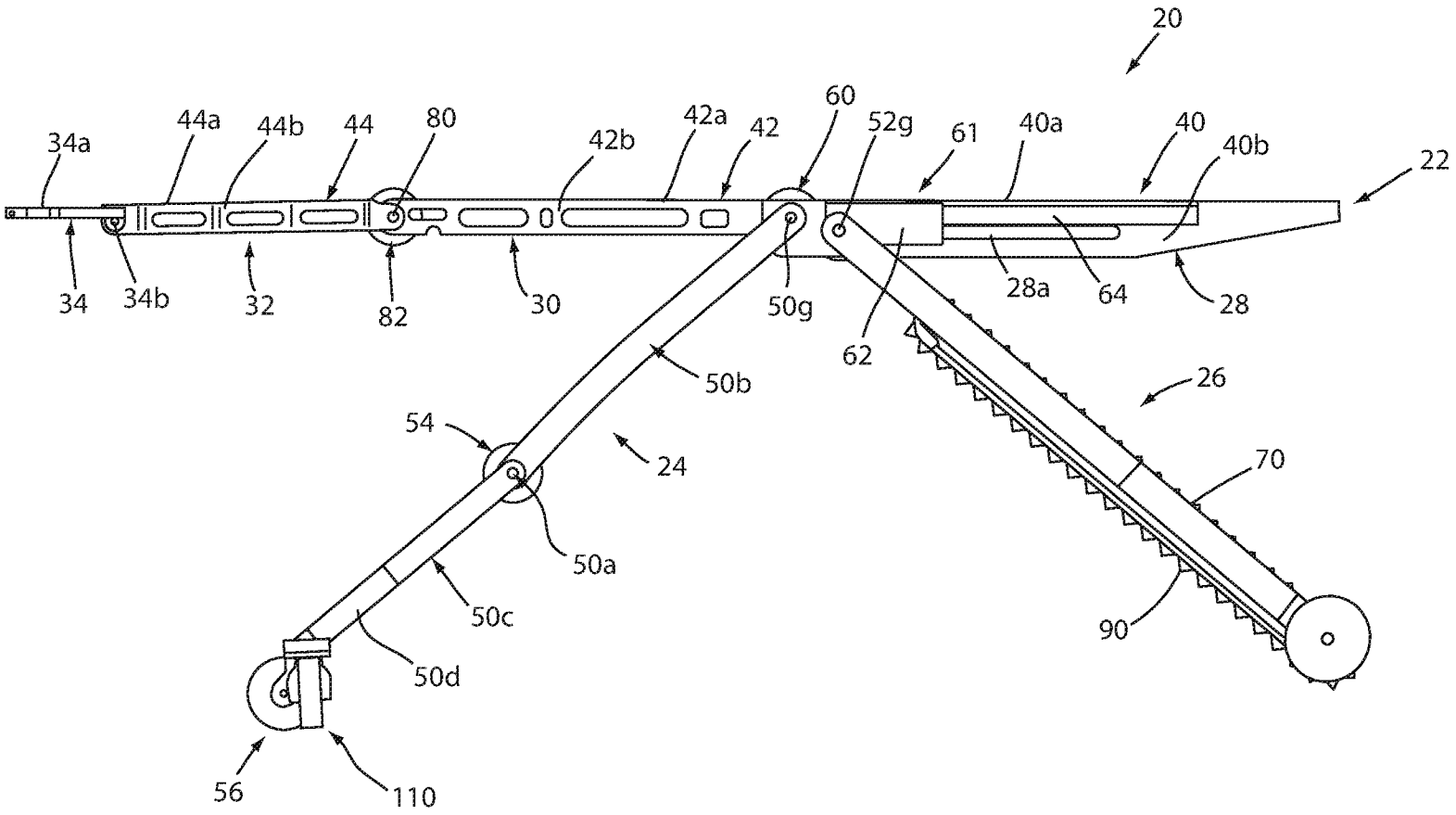
FIG. 3 is a side elevation view of the person handling apparatus of FIG. 1 shown in the supine configuration in a raised position.

As noted above, leg assembly 26 is also pivotally mounted to deck 22. In the illustrated embodiment, leg assembly 26 is pivotally and linearly mounted to deck 22 by a translatable pivot connection 61 (FIGS. 2 and 3). Legs 52 are pivotally mounted to a carrier 62 by a pivot shaft 52*g* (FIGS. 1, 2, and 6), which is rigidly coupled to legs 52 at their opposed ends and is journaled in carriers 62 so that legs 52 can pivot relative to carriers 62. Pivot shaft 52*g* extends through deck 22 in slotted openings 28*a* (FIG. 3) formed in flanges 40*b* on each side of deck 22. Carriers 62 are mounted for linear movement along on back section 28 on tracks 64, which are mounted to or formed on back section 28, to thereby form translatable pivot connection 61. In this manner, as carriers 62 move along tracks 64, shaft 52*g* (FIGS. 4 and 6) moves with the respective carrier to move the pivot connection of legs 52 along back section 28. Carriers 62 may be driven by an actuator mounted to back section 28, such as a pneumatic actuator, an electric actuator, a hydraulic actuator, or a manual mechanical actuator. Suitable actuators, therefore, include cylinders, such as a pneumatic cylinder, an electric cylinder, or a hydraulic cylinder; an acme screw; a looped chain with corresponding gears; a cog and belt assembly; a four-bar linkage; or a bell crank lever, or by any other mechanism that facilitates translational movement from one point to another point.

Figure 6:
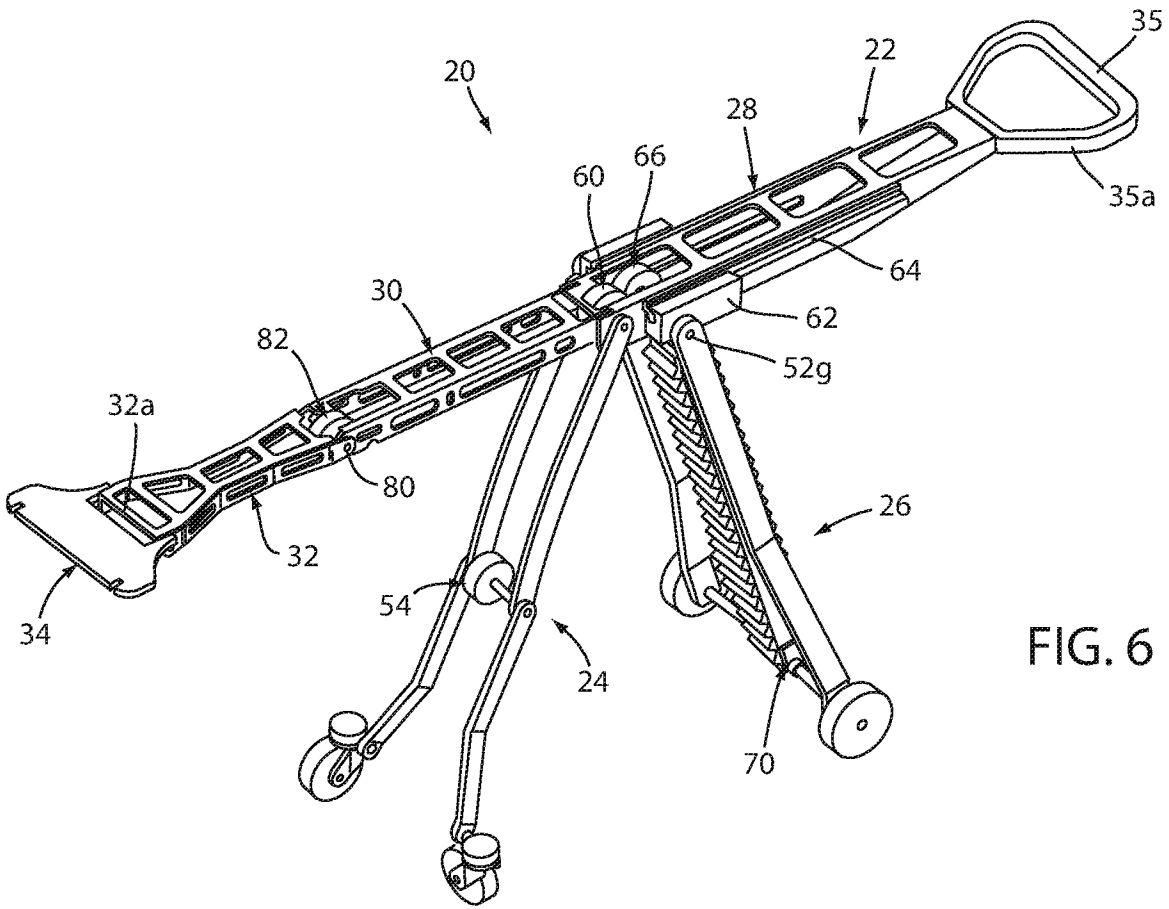
FIG. 6 is a perspective view of the person handling apparatus of FIG. 5.
Figure 7:
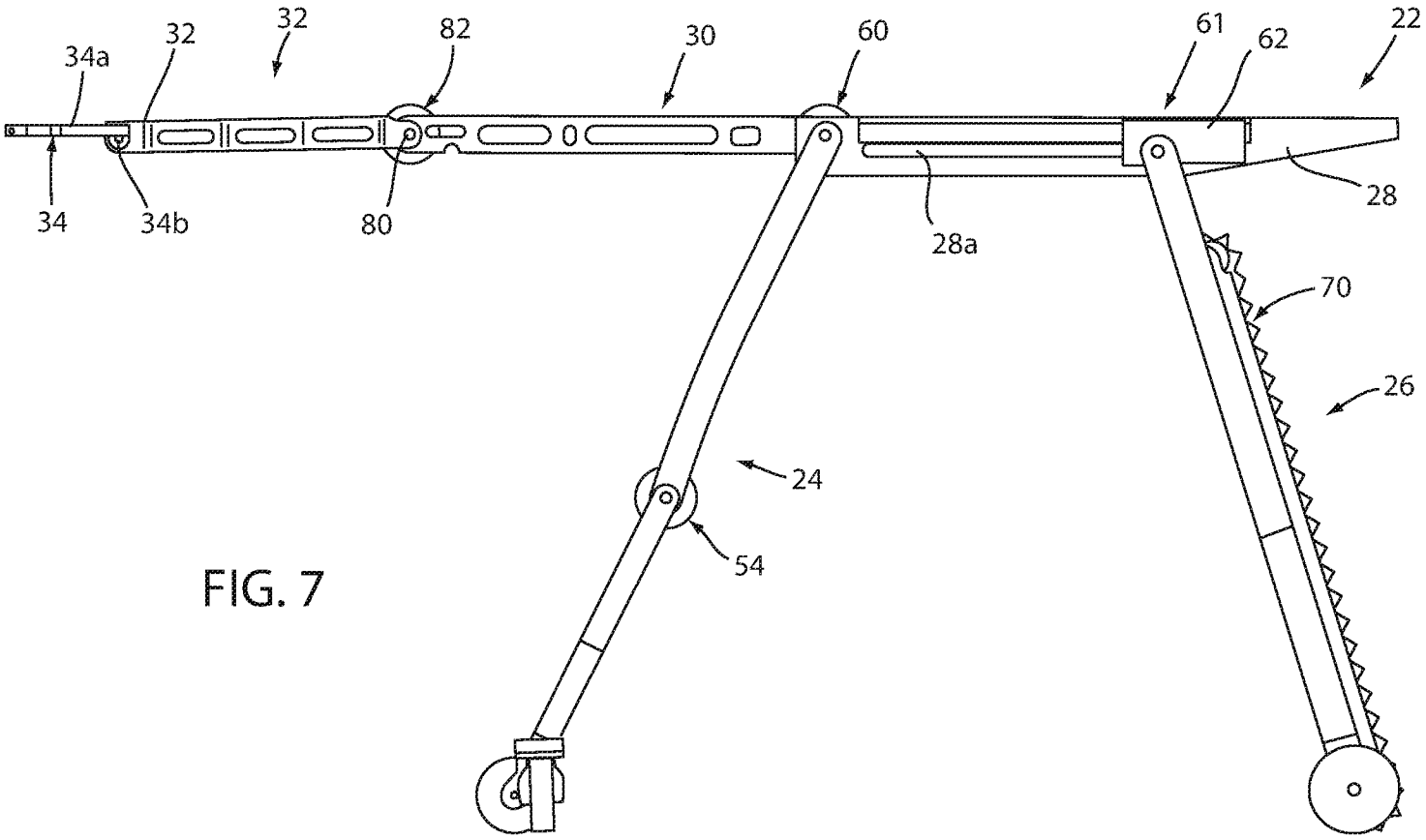
FIG. 7 is a side elevation view of the person handling apparatus illustrating the person handling apparatus is a supine raised configuration but with the leg assemblies in a more stable configuration.

Legs 52 also include an actuator 66 (FIG. 6) to pivot legs 52 about pivot shaft 52*g* (FIGS. 4 and 6). Similar to the previous described actuators, actuator 66 may include a pneumatic actuator, an electric actuator, a hydraulic actuator, or a manual mechanical actuator. In the illustrated embodiment, actuator 66 comprises a motor and rotary gear. For example, the gear may be mounted about shaft 52*g*, and is driven by its corresponding motor, which is mounted to one of the carriers 62. Alternately, as described below in reference to FIG. 8A, the translatable pivot connection 161 may include a single movable, slidable carrier 162 that extends across the deck 22 to which both legs 52 are pivotally mounted and which is moved along back section 28 of deck 22 by an actuator 165.

To facilitate transport of person handling apparatus 20, each lower leg portion 50*c*, 52*b* of legs 50, 52 supports a wheel 56, 58. As will be more fully described below, one or more of wheels 56, 58 may comprise caster wheels. Further, leg assembly 26 may support a track 70, such as a driven or powered track, so that apparatus 20 may also be used as a stair chair, as will be more fully described below in reference to FIGS. 11 and 12.

As noted above, leg section 32 is pivotal relative to seat section 30, and back section 28 is pivotal relative to seat section 30 so that deck 22 can be configured in a reclined configuration, such as shown in FIG. 9, or a chair configuration, such as shown in FIGS. 11 and 12. Suitable pivot connections may include conventional pivot mechanisms, such as shown in U.S. Pat. No. 5,537,700, entitled EMERGENCY STRETCHER WITH X-FRAME SUPPORT, commonly owned by Stryker Corporation of Kalamazoo, Mich., which is incorporated herein in its entirety. Further, the pivot mechanisms may include a detent mechanism that locks the orientation of the respective deck sections and a manual release mechanism, such as a button or handle, which releases the detent of the detent mechanism from its locked position so that the angle can be adjusted until the release mechanism is no longer actuated.

In the illustrated embodiment, each deck section 28, 30, and 32 is joined with its adjacent deck section by a pivot shaft 80 (FIG. 3, 6, 12) that forms a hinge. Similar to leg assemblies 24 and 26, each pivot shaft 80 may include an actuator 82 (actuator for pivoting seat section not shown), such as a pneumatic actuator, an electric actuator, a hydraulic actuator, or a manual mechanical actuator, including a motor and gear actuator, such as described above. In the case of motor and gear actuators 84, the gear may be mounted to the respective pivot shaft and then driven by its corresponding motor, which is mounted to the deck. For example, for suitable gear and motor arrangements, reference is made to U.S. Prov. Pat. Appls. Entitled PATIENT SUPPORT SYSTEMS WITH ROTARY ACTUATORS, Ser. No. 62/356,351, filed on Jun. 29, 2016; PATIENT SUPPORT SYSTEMS WITH ROTARY ACTUATORS COMPRISING NO-BACK DEVICES, Ser. No. 62/356,359, filed on Jun. 29, 2016; ROTARY ACTUATOR HAVING CLUTCH ASSEMBLY FOR USE WITH PATIENT SUPPORT APPARATUS, Ser. No. 62/356,366, filed on Jun. 29, 2016; PATIENT SUPPORT SYSTEMS WITH HOLLOW ROTARY ACTUATORS, Ser. No. 62/356,362, filed on Jun. 29, 2016; and PATIENT SUPPORT SYSTEMS WITH ROTARY ACTUATORS HAVING CYCLOIDAL DRIVES, Ser. No. 62/356,364, filed on Jun. 29, 2016, all filed by and commonly owned by Stryker Corporation of Kalamazoo, Mich., and which are incorporated herein by reference in their entireties.

In one embodiment, the motor is mounted to the neighboring deck, where the pivot shaft is rotatably mounted. In another embodiment, the shaft and gear are fixed to the second neighboring deck, with the motor mounted to the first neighboring deck to drive the second neighboring deck by driving the gear and shaft mounted to the second neighboring deck. As would be understood, various mounting arrangements of the pivot shaft, gear, and motor may be used to effect the relative pivoting of one deck section to another. In this manner each of the articulating components (deck sections or leg assemblies) of person handling apparatus 20 may be driven and, further, in the case of electrically controlled actuators may be controlled by a control unit described below.

Referring to FIG. 11, optionally upper leg portion 50*b* has a length that is approximately equal to the length of seat section 30. Similarly, lower leg portion 50*c* is approximately equal to or longer than the length of leg section 32 of deck 22. In this manner, when deck 22 is folded into a chair configuration (where leg section 32 is folded relative to seat section 30 and is angled downwardly toward a floor or ground surface), leg 50 may also be folded about its hinge 50*a* so that upper leg portion 50*b* and lower leg portion 50*c* can extend alongside seat section 30 and leg section 32, respectively, and provide support for the seat section 30 and leg section 32. Further, leg section 32, with or without foot section 34, may be pivoted to a position that is orthogonal to the floor or ground surface without running interference with the floor or ground surface (assuming if there is a foot section that it is folded up). Alternately, the foot section 34 may have a fixed orientation or may be adjusted so that it remains in the same orientation relative to the floor surface. For example, the foot section 34 may also include an actuator that maintains the orientation of the foot section 34 regardless of the orientation of the leg section 32, including for example, parallel to the floor surface.

Figure 8:
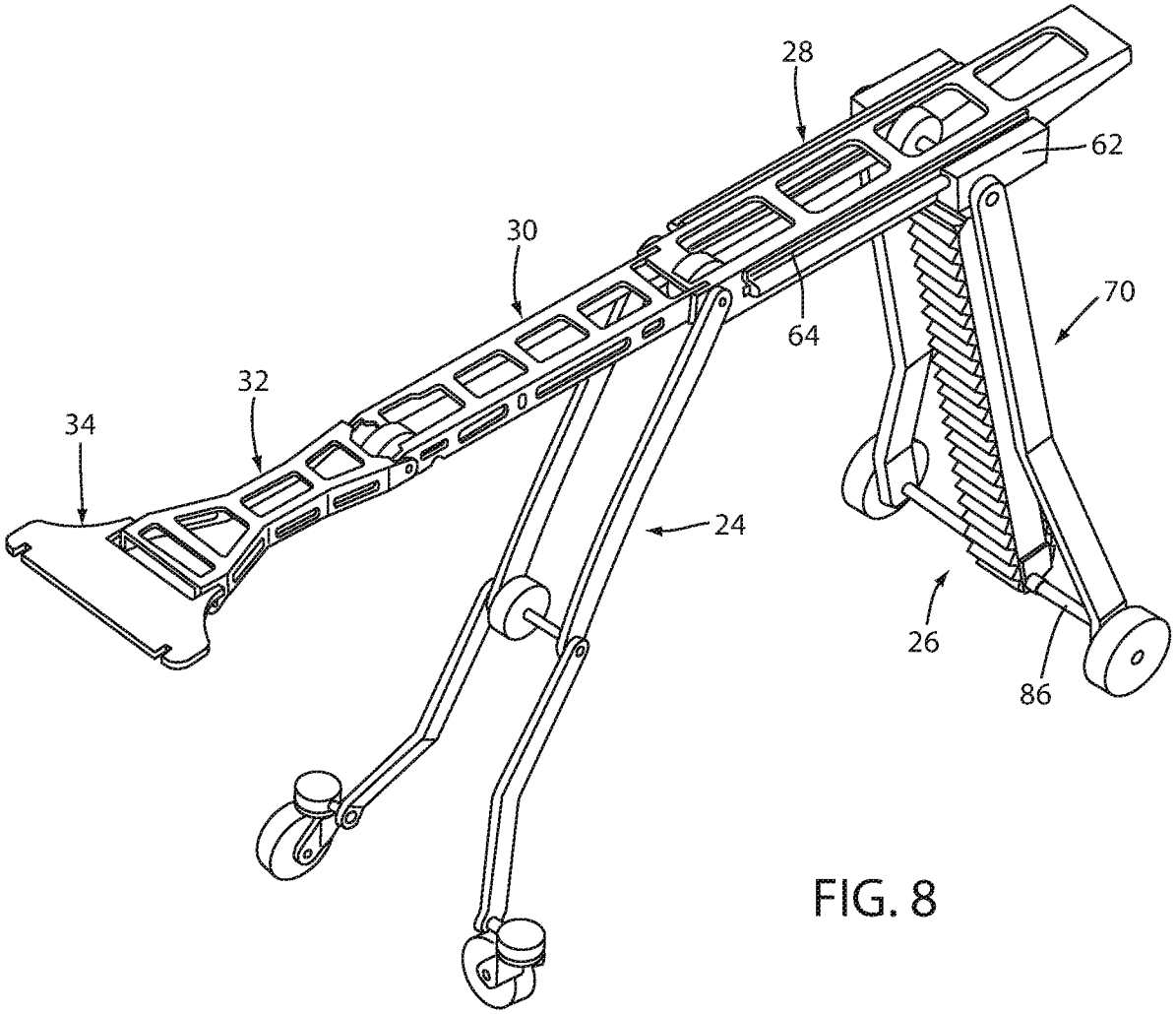
FIG. 8 is a perspective view of the person handling apparatus of FIG. 7.
Figure 8A:
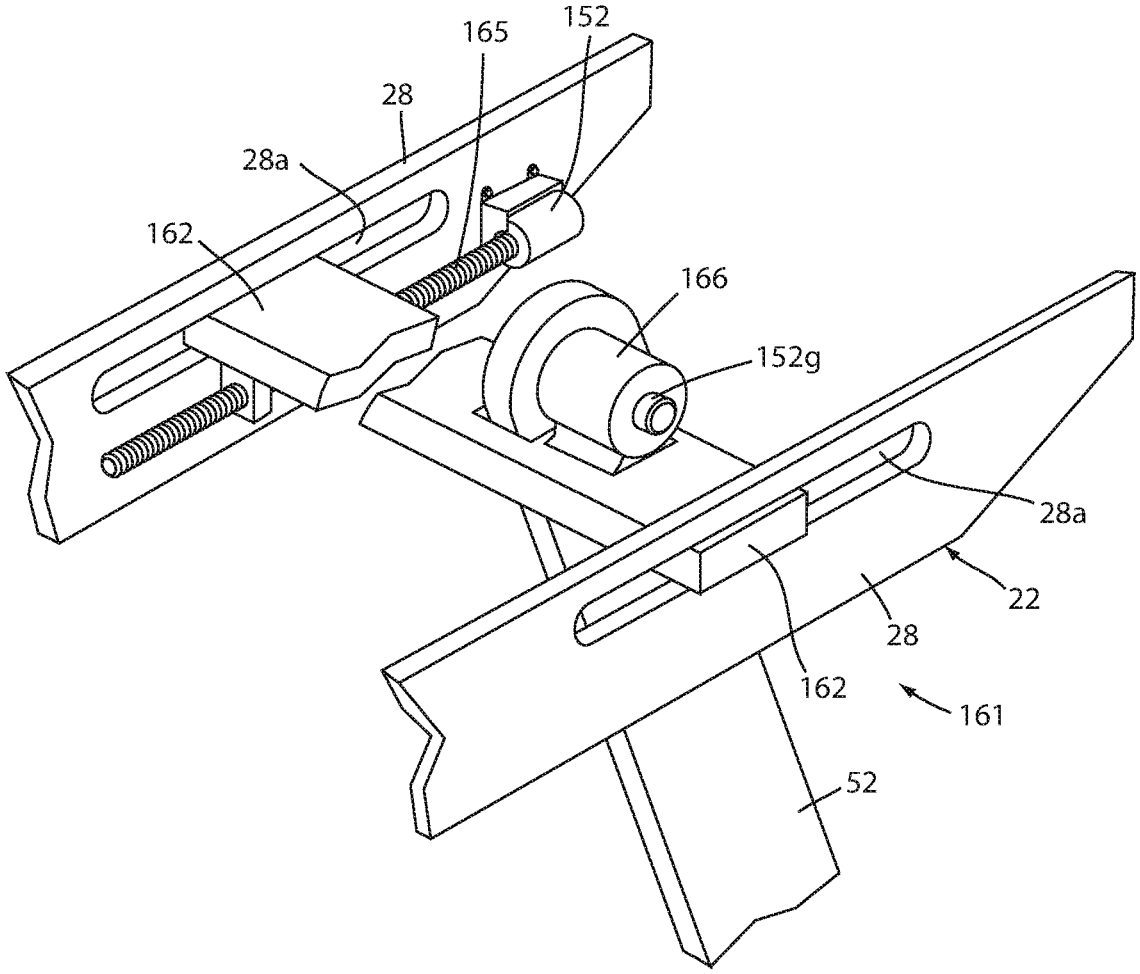
FIG. 8A is an enlarged perspective view of another embodiment of a translatable pivot connection.

As noted above, leg assembly 26 may include a track 70 so that apparatus 20 may be used as a stair chair when deck 22 is reconfigured into its chair configuration, such as shown in FIGS. 11 and 12. As best seen in FIG. 8, legs 52 of leg assembly 26 support a transverse shaft or rod 86, which is secured at both ends in legs 52 and, further, extends through legs 52 to provide a mount for wheels 58. In addition, rod 86 supports track 70. Track 70 is formed by a looped belt 90, which is mounted about a pair of spaced apart pulleys 92, which are mounted between a pair of frame members 94, such as plates, which form a track assembly. For reference of a suitable track or looped belt, reference is made to U.S. Pat. No. 9,004,204, entitled MOTORIZED SLED FOR STAIR CHAIRS, commonly owned by Stryker Corporation of Kalamazoo, Mich., which is incorporated herein by reference in its entirety.

Frame members 94 are pivotally mounted at their lower ends to shaft or rod 86 to allow track 70 to be moved from a stowed position, such as shown in FIG. 10, to a deployed position, such as shown in FIGS. 11 and 12. The position of track 70 is controlled by a control arm 98, which is pivotally mounted at one end to one or both frame members 94 and movably mounted at its opposed end by a translatable pivot connection to one or both of the legs 52 of leg assembly 26. Furthermore, track 70 may be driven or powered by an actuator, such as a motor, housed between frame members 94.

The length of track 70 optionally spans at least 3 steps of a standard staircase, which provides enhanced stability to apparatus 20 when used as a stair chair. This length can be achieved in part by the translatable pivotal connection 61 of leg assembly 26. Translatable pivotal connection 61 allows the length of legs 52 to be increased over a conventional stair chair. By increasing the length of legs 52, legs 52 can support a longer track than a conventional stair chair leg. By decreasing the angle between leg assembly 26 and deck 22, the overall vertical height of the legs can be reduced so that legs 52 can still provide the correct height (as noted below) when used as a chair, even with their increased lengths.

As noted above, leg assemblies 24 and 26 and deck sections 28, 30, 32, and 34 may be configured to provide, in essence, infinite positions. For example, as noted, in reference to FIG. 13, deck 22 may be arranged in a generally planar arrangement but moved into a vertical or near vertical orientation. In vertical or near vertical configuration, the person supported by person handling apparatus 20 is secured to the deck 22 by one or more straps and possibly a harness, depending on the condition of the person. Deck 22 is moved into this configuration by folding leg 50 so that lower leg portions 50*c* are folded toward deck 22 (as seen in FIG. 13) and by pivoting legs 52 toward the foot-end of deck 22, beyond the hinge 50*a* of legs 50, but still angled further away from deck 22 than at least the lower leg portions 50*c* of legs 50. In this manner, wheels 56 are located between wheels 58 and deck 22. In this configuration, deck 22 may be used as a vertical backboard, but then be transitioned into another configuration by pivoting the legs back to one of the other configurations noted above, or somewhere in between.

In another configuration, as noted, person handling apparatus 20 may be configured in a cot configuration and, further, in a cot loading configuration, for loading into the back opening of an emergency vehicle, such as an ambulance. As best seen in FIGS. 14-16, leg assemblies 24 and 26 may be positioned to facilitate loading of person handling apparatus 20 into the back opening of an emergency vehicle. In the illustrated embodiment in FIGS. 14-15, when deck 22 is arranged in its cot configuration, and has been moved toward the back opening of an emergency vehicle so that at least a portion of the head-end of deck 22 can be supported on the deck of the emergency vehicle, legs 50, 52 can be pivoted to facilitate loading. Once deck 22 is at least partially inserted into or supported by the deck of the emergency vehicle, an attendant can support the foot-end of the person handling apparatus 20 while legs 50 and 52 are pivoted toward the foot-end of the deck 22 so that they fold under the deck 22. This can be controlled by a user interface, or controlled remotely, for example, by a hand-held user interface as noted below. Further, track 70 may be driven to engage the deck of the emergency vehicle once inserted into the opening of the emergency vehicle, which also can be controlled by a user interface, or controlled remotely, to facilitate moving the person handling apparatus 20 into the emergency vehicle. Optionally, the track 70 may be used to assist in loading the cot into the emergency vehicle and, therefore, may be deployed to engage the outer edge, including the bumper, of the vehicle opening to in effect pull the cot into the emergency vehicle compartment.

Alternately, as shown in FIG. 15, legs 52 can be pivoted toward the head-end of the deck 22 prior to inserting the head-end of the deck 22 into the opening of the emergency vehicle so that track 70 can be used to pull person handling apparatus 20 into the emergency vehicle at the very outset. Depending on the configuration, the loading of apparatus 20 may require two attendants to hold and guide the head-end of the deck 22 until the track 70 has been inserted into the opening of the emergency vehicle a sufficient distance to support the head-end of the deck 22. In this configuration, legs 50 may remain engaged with the floor and be used to assist in guiding person support apparatus 20 into the emergency vehicle until the seat section 30 is inserted into the emergency vehicle or until person handling apparatus 20 is otherwise sufficiently inserted into the emergency. At that time, legs 50 can be folded toward the foot-end of the deck so that the person handling apparatus 20 can be fully inserted into the vehicle. Alternately, the head-end of the deck may be lengthened beyond the end of track 70 so that when the head-end of the cot is supported by the emergency vehicle, leg 52 can be folded so that it is out of the way and allow a single attendant to push the cot into the ambulance and/or optionally use the track to assist.

In one embodiment, the head-end of the cot may be retractable between an extended position (where the cot extends beyond track 70) and a retracted position to maintain the length of the deck in a more compact configuration when needed.

Figure 4A:
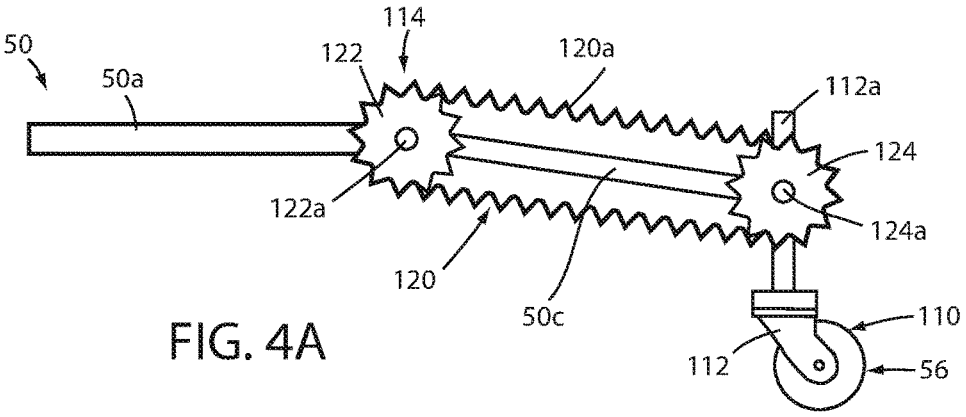
FIG. 4A is an enlarged elevation view of an actuator for maintaining the vertical pivot shaft of the caster wheel assembly in a vertical orientation.

Referring to FIGS. 1, 3 and 4, wheels 56 or wheels 58 may each comprise a conventional wheel that rotates about a pivot shaft (i.e. which rolls about a horizontal axis but does not swivel) or a caster wheel assembly (which rolls about a horizontal axis and swivels about a vertical axis). In the illustrated embodiment, and as best seen in FIG. 1, each wheel 56 comprise a caster wheel assembly 110 and includes a caster wheel 110*a* that is rotatably mounted to a yoke 112, which in turn is mounted to the distal end of one of the legs 50 of leg assembly 24. Each caster wheel assemblies 110 also includes an actuator 114 that maintains the vertical pivot shaft or pin 112*a* of the yoke 112 in a generally vertical orientation regardless of the angle of lower leg portions 50*c* of legs 50. In this manner, the swivel axis of each caster wheel assembly is maintained in a vertical orientation regardless of the position of the leg assembly. For example, suitable actuators include manual or powered actuators, such as gears and belts (such as shown in FIG. 4A); a four-bar linkage (such as shown in FIG. 4C); motors; solenoids; cylinders, including pneumatic, hydraulic, or electric cylinders; or magnets, namely electromagnets that be turned on or off to control the motion of the wheel. Optionally, any of the other casters wheel assemblies (e.g. such as wheels 58) provided on apparatus 20 may incorporate an actuator to maintain the caster wheel in a vertical orientation. Alternately, the vertical pivot mechanism (e.g. the vertical pivot shaft 112*a* and yoke 112) may also be actuated by another part of patient support apparatus, such as a pin on the deck to move (e.g. lock or unlock) the vertical pivot axis mechanism. For further details of a caster wheel assembly and mechanism to move the wheel of the caster wheel between an operative position and a non-operative position, reference is made to U.S. Prov. Pat. Appl. Ser. No. 62/369,423, filed Aug. 1, 2016, entitled PERSON SUPPORT APPARATUS SYSTEM, and U.S. Ser. No. 15/664,831 filed Jul. 31, 2017 entitled PERSON SUPPORT APPARATUS SYSTEM, by Applicant Stryker Corporation which are incorporated by reference herein in their entireties.

Figure 4B:
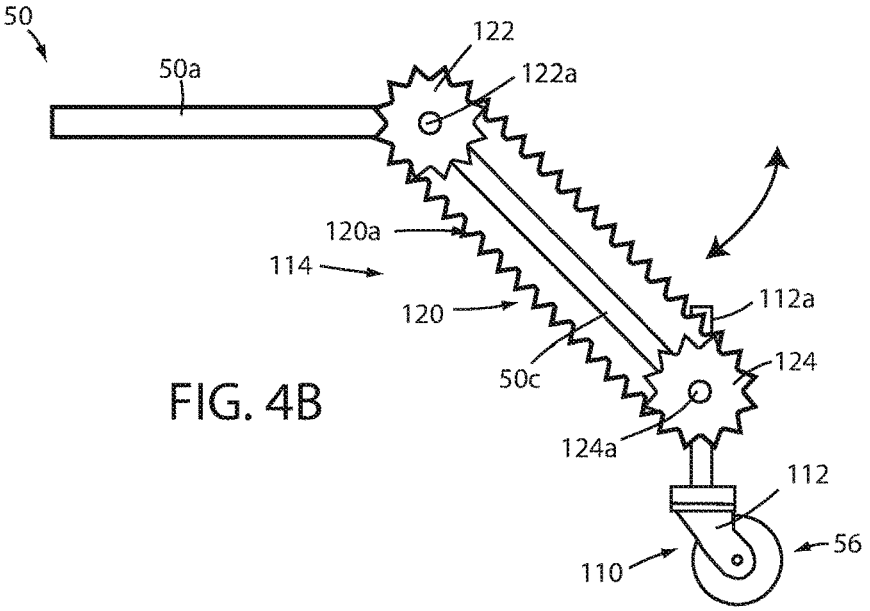
FIG. 4B is a similar view to FIG. 4A showing the actuator maintaining the vertical pivot shaft in its vertical orientation when the leg of the person handling apparatus is lowered.
Figure 4C:
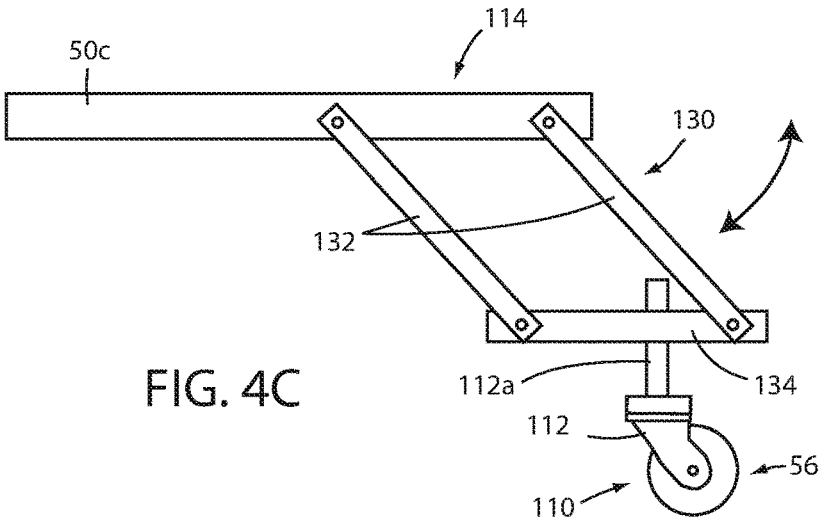
FIG. 4C is an enlarged elevation view of another embodiment of an actuator for maintaining the vertical pivot shaft of the caster wheel assembly in a vertical orientation.
Figure 5:
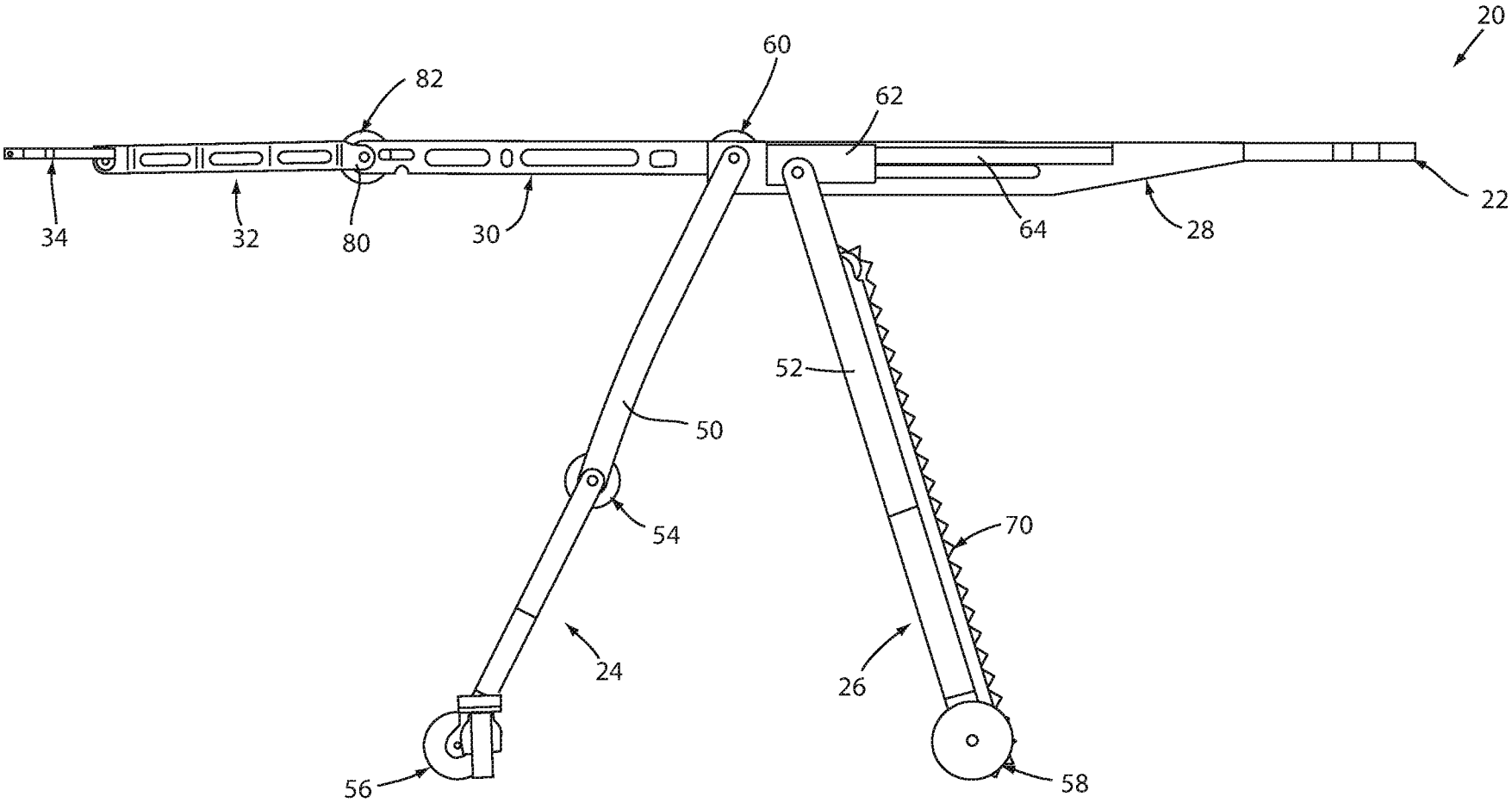
FIG. 5 is a similar view to FIG. 3 illustrating a person handling apparatus in a fully raised position.

For example, referring to FIGS. 4A and 4B, as noted above, in one embodiment actuator 114 comprises a gear and belt assembly 120. Gear and belt assembly 120 includes a first gear 122 rotatably mounted about a shaft 122*a*, which is fixedly mounted to the upper end of lower leg portion 50*c* of the respective leg 50 at its pivot axis, and a second gear 124 fixedly mounted about a shaft 124*a*, which is journaled to the lower end of lower leg portion 50*c* and fixedly mounted to vertical pivot shaft 112*a*. Gear and belt assembly 120 further includes a chain or cogged belt 120*a* that extends around the gears so that rotation of the lower leg portion 50*c* about its pivot axis will cause first gear 122 to rotate and thereby pull on chain or cogged belt 120*a* inducing rotating of second gear 124, which in turn rotates vertical pivot shaft 112*a* to maintain the vertical pivot shaft 112*a* vertical. As would be understood, the size of the gears may be varied to control the rate of rotation of the vertical pivot shaft 112*a* to thereby maintain the vertical pivot shaft 112*a* vertical.

In another embodiment, actuator 114 comprises a four-bar linkage assembly 130, with a pair of parallel arms 132 that are pinned at their upper ends to lower leg portion 50*c* of a respective leg 50. Lower ends of arms 132 are pinned to a cross-bar 134 to thereby form a four-bar linkage with the lower leg portion 50*c*. Vertical pivot shaft 112*a* is coupled cross-bar 134 so that as lower leg portion 50*c* is raised, the weight of the caster wheel assembly 110 on cross-bar 134 will pull on cross-bar 134 causing four-bar linkage assembly 130 to expand with cross-bar 134 remaining generally parallel to the floor surface. Thus, vertical pivot shaft 112*a* will remain vertical. When lower leg portion 50*c* is lowered, the caster wheel assembly will push up on cross-bar 134 causing four-bar linkage assembly 130 to fold with cross-bar 134 remaining generally parallel to the floor surface. Again, vertical pivot shaft 112*a* will remain vertical.

As noted above, deck 22 includes multiple articulatable deck sections 28, 30, 32, and 34. Optionally, in another embodiment, each deck section may be formed from a frame with a web or skin that extends over the frame to form a patient support surface on each deck. For example, the frame or the web or skin may be metal or plastic or a combination of both. Optionally, one or more deck sections may be formed form a panel with a honeycomb or corrugated construction, for example, honeycomb or corrugated aluminum, which can reduce the weight of the deck sections and/or increase the stiffness and, further, capacity of the deck sections.

To provide comfort to a person seated or lying on deck 22, each section 28, 30 and 32 (and foot section 34) may be coated or have a pad, including a foam pad, a gel pad or a combination of both, and/or a fabric cover, such as a stretch fabric, which is applied over the channel members (or panels) forming the respective deck sections. Suitable gel materials for forming the gel pad or cushioning material may be formed by blending an A-B-A triblock copolymer with a plasticizer oil, such as mineral oil. The "A" component in the A-B-A triblock copolymer is a crystalline polymer like polystyrene and the "B" component is an elastomer polymer like poly(ethylene-propylene) to form a SEPS polymer, a poly (ethylene-butadiene) to form a SEBS polymer, or hydrogenated poly(isoprene+butadiene) to form a SEEPS polymer. For examples of suitable gels for covering or being applied to any of the deck sections, or for covering or being applied to the side rails reference is made to U.S. Pat. Nos. 3,485,787; 3,676,387; 3,827,999; 4,259,540; 4,351,913; 4,369,284; 4,618,213; 5,262,468; 5,508,334; 5,239,723; 5,475,890; 5,334,646; 5,336,708; 4,432,607; 4,492,428; 4,497,538; 4,509,821; 4,709,982; 4,716,183; 4,798,853; 4,942,270; 5,149,736; 5,331,036; 5,881,409; 5,994,450; 5,749,111; 6,026,527; 6,197,099; 6,843,873; 6,865,759; 7,060,213; 6,413,458; 7,730,566; 7,823,233; 7,827,636; 7,823,234; and 7,964,664, which are all incorporated herein by reference in their entireties.

Other formulations of gel materials may also be used in addition to those identified in these patents. As one example, the gel material may be formulated with a weight ratio of oil to polymer of approximately 3.1 to 1. The polymer may be Kraton 1830 available from Kraton Polymers, which has a place of business in Houston, Tex., or it may be another suitable polymer. The oil may be mineral oil, or another suitable oil. One or more stabilizers may also be added. Additional ingredients—such as, but not limited to—dye may also be added. In another example, the gelatinous elastomeric material may be formulated with a weight ratio of oil to copolymers of approximately 2.6 to 1. The copolymers may be Septon 4055 and 4044 which are available from Kuraray America, Inc., which has a place of business in Houston, Tex., or it may be other copolymers. If Septon 4055 and 4044 are used, the weight ratio may be approximately 2.3 to 1 of Septon 4055 to Septon 4044. The oil may be mineral oil, and one or more stabilizers may also be used. Additional ingredients—such as, but not limited to—dye may also be added. In addition to these two examples, as well as those disclosed in the aforementioned patents, still other formulations may be used.

As noted above, translatable pivot connection 161 (FIG. 8A) may be formed from a single movable, slidable carrier 162 that extends across the deck 22 and through slotted openings 28*a* formed in the flanges of back section 28 on each side of deck 22. Legs 52 are each pivotally mounted to carrier 162 by respective pivot shafts 152*g*, which are driven to rotate about their longitudinal axes by one or more actuators 166 (only one shown). In this manner, one actuator may be used to drive both legs or to drive one leg. For example, the actuator or each actuator 166 may comprise a motor and gear, with the gear mounted to the shaft 152*g* and the motor mounted to the carrier.

Carrier 162 is mounted for linear movement along slotted openings 28*a* in back section 28 to thereby form translatable pivot connection 161. In this manner, as carrier 162 moves along back section 28, shafts 152*g* move with the respective carrier to move the pivot connection of legs 52 along back section 28. Carrier 162 may be driven by an actuator 165 mounted to back section 28, such as pneumatic actuator, electric actuator, hydraulic actuator, or a manual mechanical actuator. In the illustrated embodiment, actuator 165 comprises an acme screw and motor. Motor 152 may be mounted to the back section 28 adjacent the end of the screw supported on the carrier 162. Alternately, motor 152 may be mounted to the frame. Other suitable actuators, therefore, include cylinders, such as a pneumatic cylinder, an electric cylinder, or a hydraulic cylinder; a looped chain with corresponding gears; a cog and belt assembly; a 4-bar linkage; or a bell crank lever, or by any other mechanism that facilitates translational movement from one point to another point.

As noted above, person handling apparatus 20 optionally includes one or more powered components—all of which may be controlled locally, for example, by way of a user interface, or controlled remotely, for example, by a hand-held user interface or from an interface in an emergency vehicle. In one embodiment, person handling apparatus 20 includes a control unit 100 (FIG. 10, shown mounted to handle 35) with one or more user input devices, such as buttons, or a touch screen, to enable a user to control the various powered components, including the referenced actuators, such as the motors, or other control circuitry for operating any hydraulic or pneumatic components that may be used. As noted, the control unit 100 may be mounted to person handling apparatus 20 or comprise a hand-held device to allow remote communication with an onboard processor, for example located under the seat section or in the back section, to control of the various powered components.

In one embodiment, the remote control unit uses the communication systems described in U.S. patent application Ser. No. 14/211,613, filed on Mar. 14, 2014, by Applicants Michael Joseph Hayes et al., entitled PATIENT SUPPORT APPARATUS WITH REMOTE COMMUNICATIONS (STR03 P-414B), which is incorporated by reference herein in its entirety.

Accordingly, the person handling apparatus 20 described herein can facilitate handling of a patient while reducing the strain or stress on a caregiver. Further, when powered actuators are used to pivot the various pivot connections, person handling apparatus 20 can be reconfigured into an infinite number of operative (where it can support a person and be used to transport a person) configurations, including the illustrated cot configuration, recliner chair configuration, or stair chair configuration. Additionally, because the person handling apparatus is a single integrated apparatus, there is no need to disassemble and reassemble or change equipment. As a result, the use of the person handling apparatuses described herein can reduce the amount of time spent handling a person and getting them into the correct configuration for transport.

Although described as having powered pivot connections, it should be understood that one or more of the pivot connections may be manual and, further, may include detent mechanisms to define discrete positions for respective pivoting components. For example, clutch packs or manually lockable joints may be used at any of the above noted pivot connections so that no gearing is required.

Figure 17:
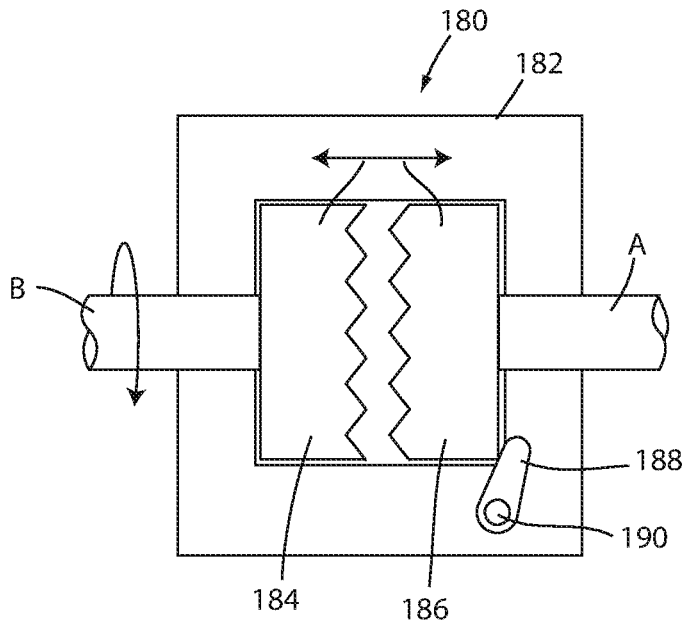
FIG. 17 is a schematic view of another embodiment of a pivot mechanism that can be used at any of the pivot connections.

As best seen in FIG. 17, a manually lockable joint 180 may include a coupler 182 that is fixed to one of the components, such as component A, and rotatably mounted to the other component, such as component B. Component A may represent one of the deck sections or leg sections, and component B may represent another deck section or a leg or leg section.

Mounted to the ends of each of the respective components A, B is a disc 184, 186 with ridges or teeth on their inwardly facing side so that when the two discs 184, 186 are meshed together, they rotatably couple the two components together. One of the discs, for example disc 184, is fixedly coupled to its respective component B, while the other disc 186 is mounted to linearly translate along its respective component A so that disc 186 can move toward or away from disc 184. Manually lockable joint 180 also includes a manual actuator 188, which is supported by coupler 182. Manual actuator 188 may include a lobed cam 190 and a handle or toggle arm (not shown) that is coupled to the cam and selectively rotates cam 190 between a locking position and an unlocking position. The handle is accessible from coupler 182 and, as noted, operable to rotate cam 190. As the handle or toggle arm is rotated or twisted, cam 190 pushes on the movable disc 186 toward disc 184 to urge the two discs 184, 186 together and thereby lock the pivot connection. When the handle or toggle arm is rotated or twisted in the opposite direction, cam 190 no longer pushes disc 186 toward disc 184. To separate the discs, disc 186 may include a spring, for example, to urge disc 186 away from disc 184 so that when no longer pushed by cam 190, the two discs are separated so that one or both components may be pivoted. Alternately, the lobed cam may be replaced with a toggle body that is engaged with disc 186 to pull or push disc 186 toward or away from disc 184.

Figure 19:
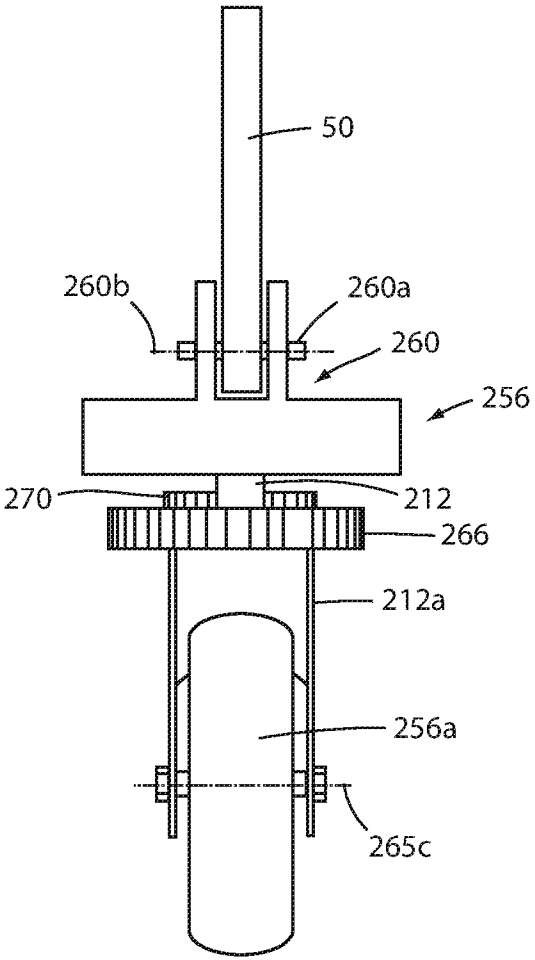
FIG. 19 is an enlarged front elevation view of the second embodiment of the caster assembly.
Figure 18:
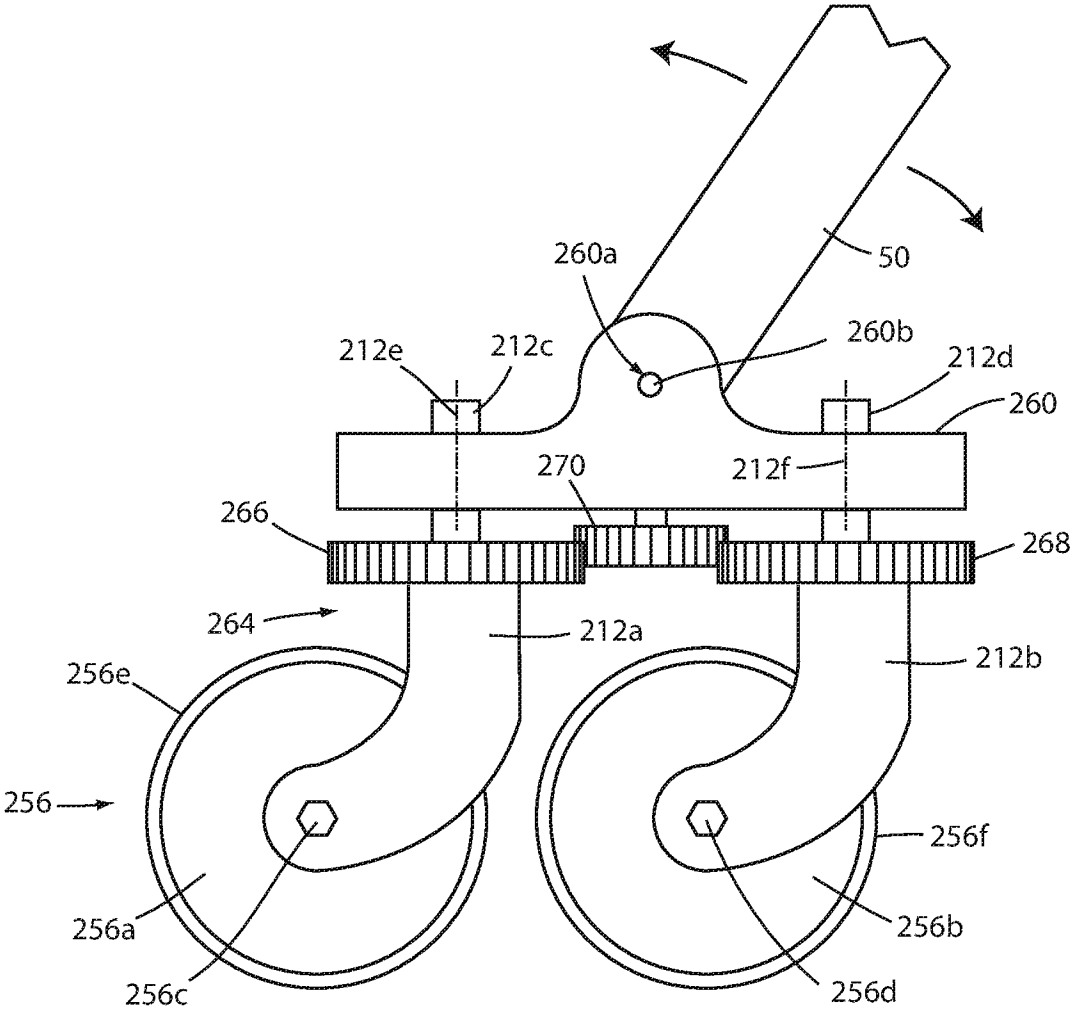
FIG. 18 is an enlarged side elevation view of a second embodiment of a caster assembly that may be used in the person handling apparatus.

Referring to FIGS. 18 and 19, the numeral 256 generally designates a second embodiment of a suitable caster assembly that may be mounted to legs 50 and used in lieu of the caster wheel assemblies described above in reference to person handling apparatus 20. As will be more fully explained below, each caster assembly 256 comprises a self-positioning caster assembly that will keep its swivel axis of rotation generally the same (e.g. vertical or nearly vertical) regardless of the position of the leg or the surface on which person handling apparatus 20 is transported or supported.

As best seen in FIG. 18, each caster wheel assembly 256 includes first and second caster wheels 256*a* and 256*b*. Each caster wheel 256*a* and 256*b* is rotatably mounted to a respective yoke 212*a*, 212*b* about an axis of rotation 256*c*, 256*d*, respectively, which axes are generally horizontal and form the rolling axes of the caster assembly 256. Yokes 212*a*, 212*b* in turn are commonly rotationally mounted to a bracket 260 by shafts or pins 212*c*, 212*d* about generally vertical axes 212*e*, 212*f*, respectively, which form the swivel axes of the caster wheels. The terms "vertical" and "horizontal" as used herein are used in reference to the orientation shown in FIG. 18 and in use may be offset from true vertical and horizontal when the support surface is angled, as would be understood.

Bracket 260 is then pivotally mounted, optionally at a medial portion thereof, to the end, or near the end, of a respective leg 50 by a pivot connection 260*a*. Pivot connection 260*a* has an axis of rotation 260*b* that is parallel to the axis of rotation 256*c*, 256*d* of each caster wheel 256*a*, 256*b*. In this manner, caster wheel assembly 256 is decoupled from its respective leg 50 about axis of rotation 260*b*. In other words, any moment forces generated by caster wheel assembly 256 about axis of rotation 260*b* will result in the caster wheel assembly 256 rotating about axis 260*b* but not impact the orientation of leg 50. Similarly, if leg 50 changes its orientation, moment forces from such a change in leg orientation are decoupled from the caster wheel assembly 256 and therefore will not impact the orientation of caster wheel assembly 256.

As a result, when caster wheels 256*a*, 256*b* encounter a change in the ground surface, e.g. a change in slope, they will generate (under the force of gravity) a moment about axis 260*b* that induces bracket 260 to pivot about its pivot axis 260*b* so that caster wheels 256*a*, 256*b* can follow the change in ground surface. As such, caster wheel assemblies 256 are self-positioning and can adjust to different terrains and are able to maintain their swivel axes generally vertical or orthogonal to the support surface on which the person handling apparatus is supported. Additionally, the orientation of caster wheel assemblies 256 is not impacted by a change in orientation of the legs 50. In this manner, the swivel axes of each caster wheel assembly 256 is maintained (e.g. in a vertical orientation or orthogonal to the support surface on which the person handling apparatus is supported) regardless of the surface terrain or the position of the leg.

To form a compact caster assembly, caster wheels 256*a*, 256*b* are mounted to bracket 260 so that their contact points with a support surface form a foot print of about 3.5 square inches. Stated another way, their outer wheel perimeters 256*e*, 256*f* are spaced from each other at a close distance when they are oriented in the same direction. For example, when caster wheels 256*a*, 256*b* are oriented in the same direction, their outer wheel perimeters 256*e*, 256*f* are spaced at a close distance X in a range of about 0.266 to 0.243 inches (about 6.35 mm), or in a range of about 0.391 to 0.359 inches (about 9.52 mm), or in a range of about 0.516 to 0.484 inches (about 12.7 mm). Further, wheels 256*a*, 256*b* are maintained in the same orientation (with respect to each other) about their swivel axes 212*e*, 212*f*, otherwise the wheels could interfere with each other.

Figure 20:
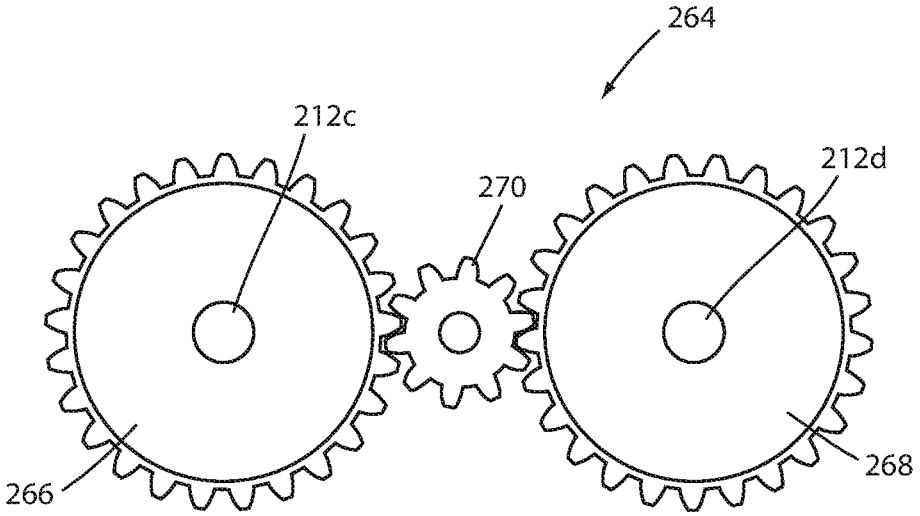
FIG. 20 is a fragmentary plan view illustrating a caster synchronizing assembly of the caster assembly of FIG. 18.

To maintain the wheels in the same orientation (with respect to each other) about their swivel axes 212*e*, 212*f* and enable the compact configuration (without generating interference between the two caster wheels), each caster wheel assembly 256 also includes a caster synchronizing assembly 264. As best seen in FIGS. 18 and 20, each caster synchronizing assembly 264 includes a first force transmitting coupler 266 mounted to yoke 212*a* and a second force transmitting coupler 268 mounted to yoke 212*b*. For example, first force transmitting coupler 266 may be mounted to yoke 212*a* on a shoulder of yoke 212*a* about pin or shaft 212*c*, and second force transmitting coupler 268 may be mounted to yoke 212*b* on a shoulder of yoke 212*b* about pin or shaft 212*d*. Further, first force transmitting coupler 266 is coupled to second force transmitting coupler 268 by a third force transmitting couple 270, which transmits rotation force from one of the force transmitting coupler to the other force transmitting coupler and thereby synchronize the rotation of each caster wheel about their respective swivel axes.

In the illustrated embodiment, first force transmitting coupler 266 comprises a gear mounted to yoke 212*a*, and second force transmitting coupler 268 comprises a gear mounted to yoke 212*b*. The types of gears may include spur gears, bevel gears, helical gears, worm gears or the like. Similarly, third force transmitting coupler 270 may comprise a gear that transmits the forces between the two gears (of the first and second force transmitting couplers), and its type depends on the type of gears provided for first force transmitting coupler 266 and second force transmitting coupler 268. Third force transmitting coupler 270 is positioned between the two gears to transmit the forces there between and is mounted to bracket for support. In this manner, as one caster wheel 256*a* or 256*b* is pushed or guided about its swivel axis, caster synchronizing assembly 264 will rotate the other caster wheel about its swivel axis to synchronize the caster wheels and maintain the caster wheels in the same orientation with respect to each other.

Figure 21:
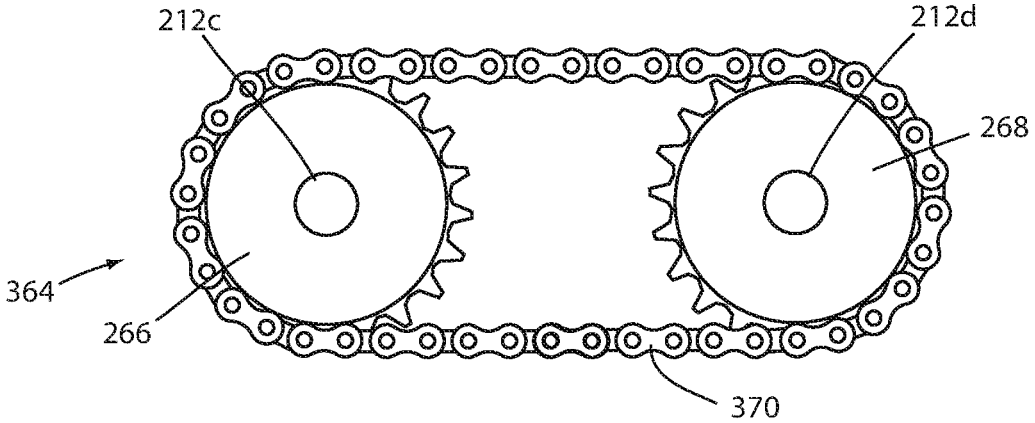
FIG. 21 is a fragmentary plan view illustrating a second embodiment of a caster synchronizing assembly.

Referring to FIG. 21, alternately, a second embodiment of a caster synchronizing assembly 364 may include chain 370 for the third force transmitting coupler. Chain 370 extends around and transmits the forces between first and second force transmitting couplers 266, 268 to thereby synchronize the swivel movement of the caster wheels.

Figure 21A:
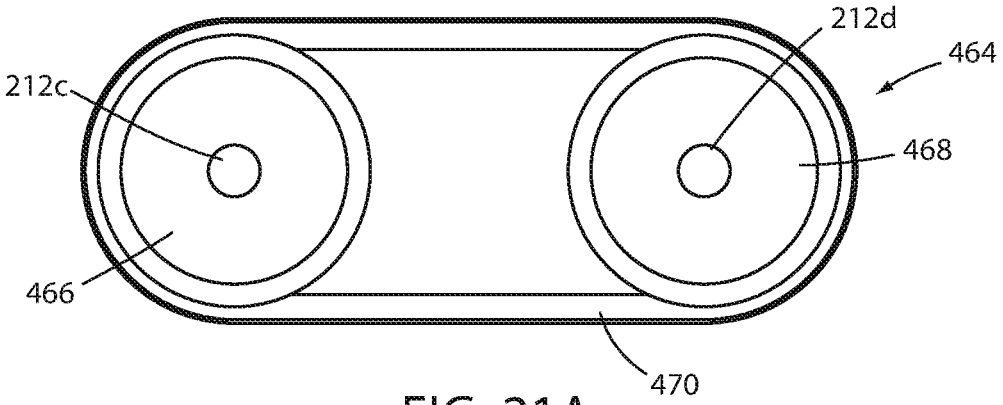
FIG. 21A is a fragmentary plan view illustrating a third embodiment of a caster synchronizing assembly.

In a third embodiment of a caster synchronizing assembly 464 (FIG. 21A), first and second force transmitting couplers 466, 468 may comprise pulleys (mounted about pins 212*c*, 212*d*), and a third force transmitting coupler 470 may comprise a belt that extends around and transmits the forces between first and second force transmitting couplers 466, 468 to thereby synchronize the swivel movement of the caster wheels.

In the second and third embodiment, the third force transmitting coupler is supported by the first and second force transmitting couplers and need not be mounted to the bracket of the respectively caster wheel assemblies.

Optionally, any of caster assemblies described above may incorporate a default position mechanism. For example, a suitable default position mechanism may include a magnet (or magnets) that is located such that when the caster assemblies are lifted from the supporting surface (e.g. such as a floor), the magnets will pull on the caster wheels so they are returned to designated default or home position (i.e. where the magnets hold them).

In yet another embodiment, any of the above caster assemblies may incorporate a steer lock mechanism to lock the caster wheels in a desired orientation about their respective swivel axes. For example, each caster assembly 254 may incorporate a lever that is mounted to its bracket 260, for example, that is operable to engage one of force transmitting couplers of the caster synchronizing assembly 264, 364, or 464.

Figure 27:
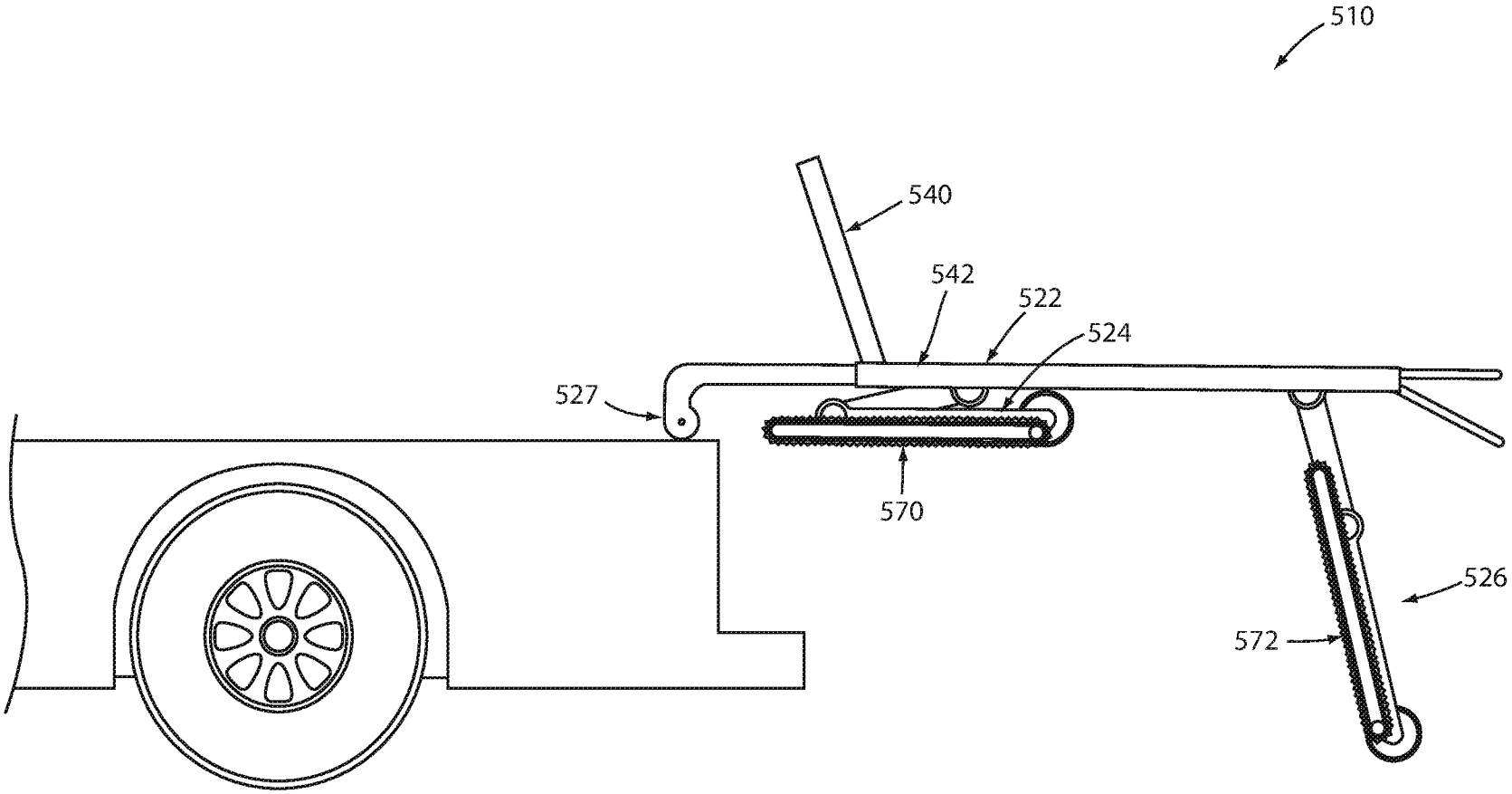
FIG. 27 is a similar view to FIG. 26 illustrating the person handling apparatus with its head-end leg assemblies and tracks folded for insertion of the person handling apparatus into the emergency vehicle.
Figure 28:
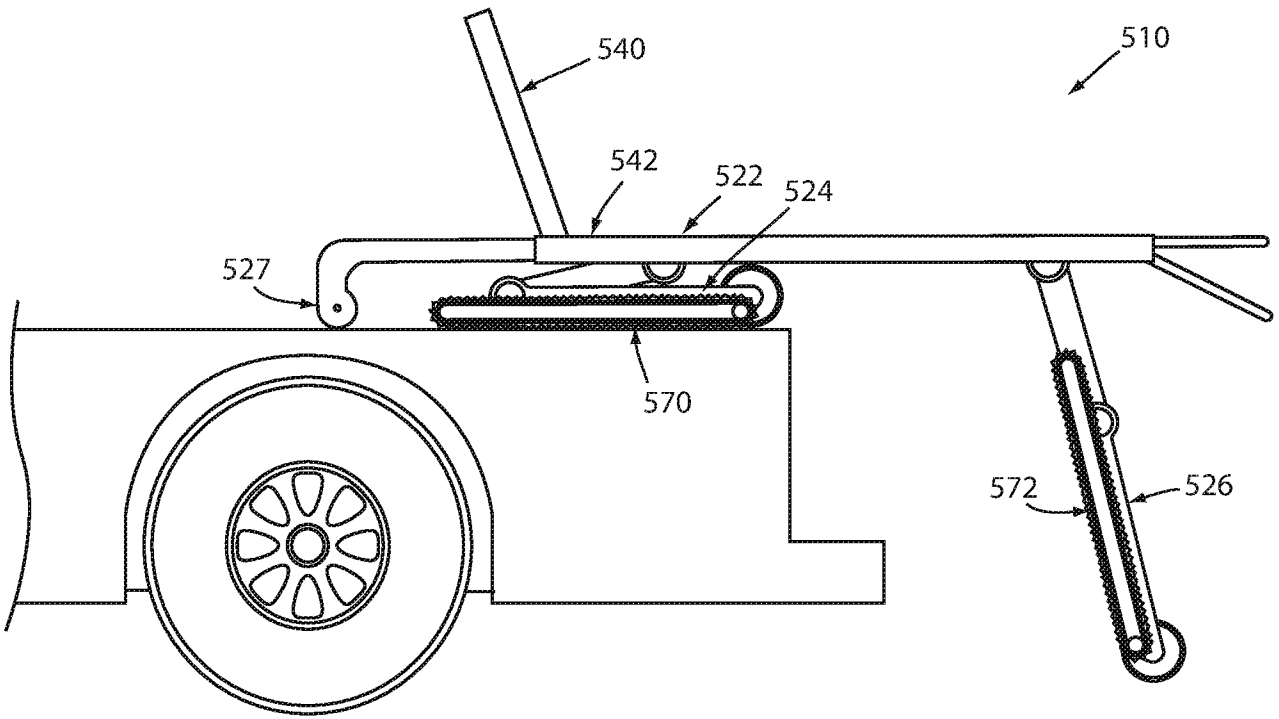
FIG. 28 is a similar view to FIG. 27 illustrating the person handling apparatus partially inserted into the rear compartment of an emergency vehicle.

Referring to FIGS. 22-34, the numeral 510 generally designates another embodiment of a person handling apparatus. As will be more fully described below, person handling apparatus 510 includes a deck 522 and two pairs (e.g. first and second pairs) of track assemblies 570, 572, which are mounted relative to the deck independently of each other so that at least one pair of the track assemblies can be independently positioned to engage the same surface or can be independently positioned to engage different surfaces, including surface with different orientations. For example, when person handling apparatus 510 is used to transport a person down a set of stairs, such as shown in FIGS. 30-34, one pair of track assemblies may engage the floor at the top of the stairs, while the other pair of track assemblies may be positioned to engage the steps of the stairs (and, therefore, have a different orientation than the tracks of the head-end leg assemblies, for example). Similarly, while one pair of track assemblies is moved to a deployed position to engage a surface (such as the floor of an emergency vehicle (FIG. 28) or stairs (FIGS. 32-33)), the other pair of track assemblies may be moved to a folded, stowed or non-deployed position (for example as shown in FIGS. 28 and 33).

Referring again to FIG. 22, as noted above, person handling apparatus 510 includes deck 522. Deck 522 may comprise a cot deck or a stretcher deck with one or more articulatable sections, such as an articulatable back section 540, which is pivotally mounted to a seat section 542, or a deck such as described above with multiple deck sections (for example, back, seat and leg sections). For further details of the overall structure of suitable decks or for further details of other features that may be incorporated into the person handling apparatus 510, reference is made to U.S. Pat. Nos. 5,537,700; 6,125,485; 6,276,010; 6,735,794; 7,100,224; 7,398,571; 7,478,855; 7,887,113; 8,439,416; and WO 2004/064698, for example, all commonly assigned to Stryker Corporation of Kalamazoo, Mich., which are incorporated by reference in their entireties herein.

Further, for each articulatable section, person handling apparatus 510 may include one or more actuators, such as an air cylinder or hydraulic cylinder to at least reduce the force necessary to raise or slow the lowering of the articulatable section. For ease of description, deck 522 will described in the context of a cot deck with an articulating back section, though it should be understood that the features described below can be used with other types of decks as noted and described above.

Figure 22:
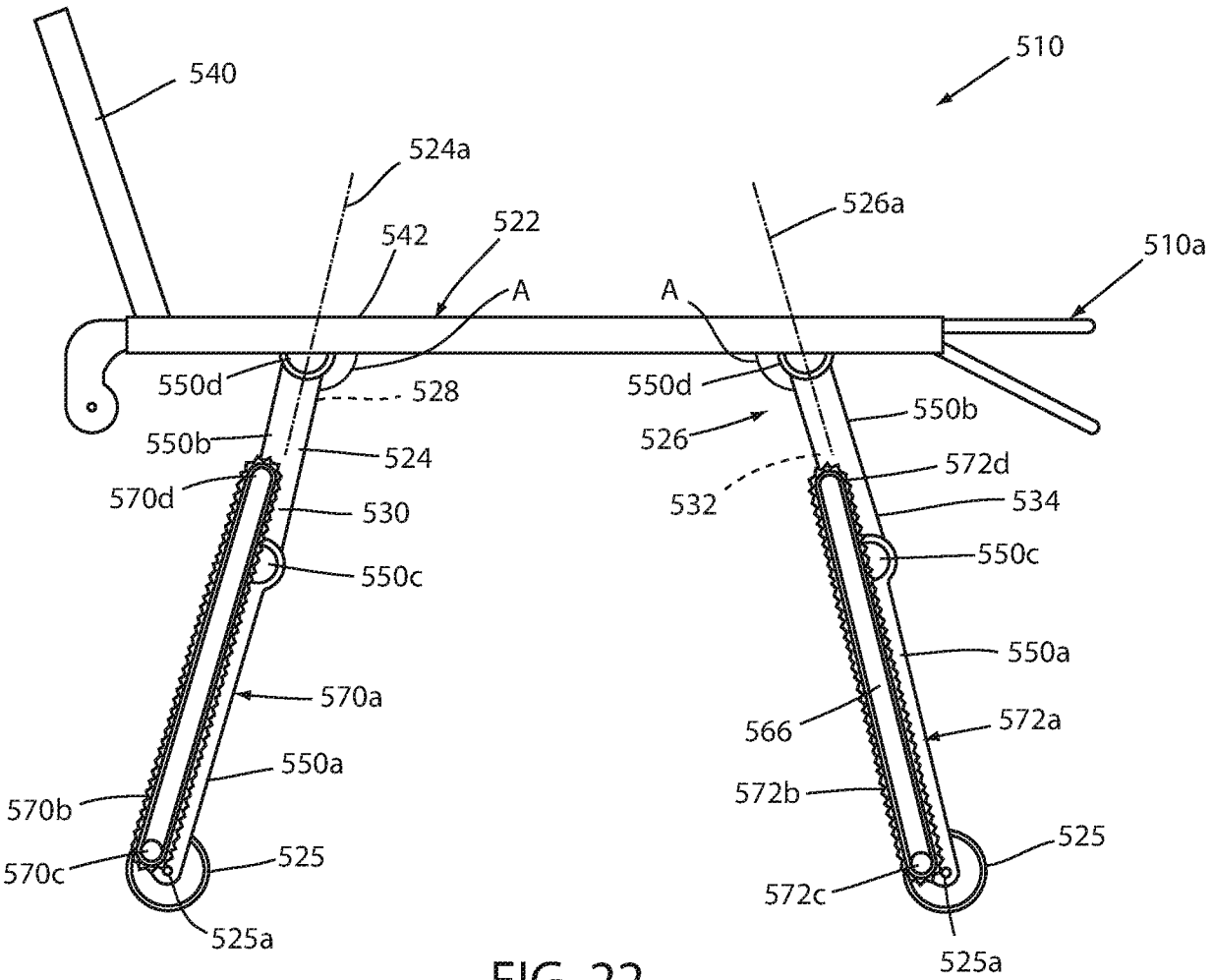
FIG. 22 is a side elevation view of another embodiment of a person handling apparatus with the person handling apparatus shown in a raised configuration.
Figure 23:
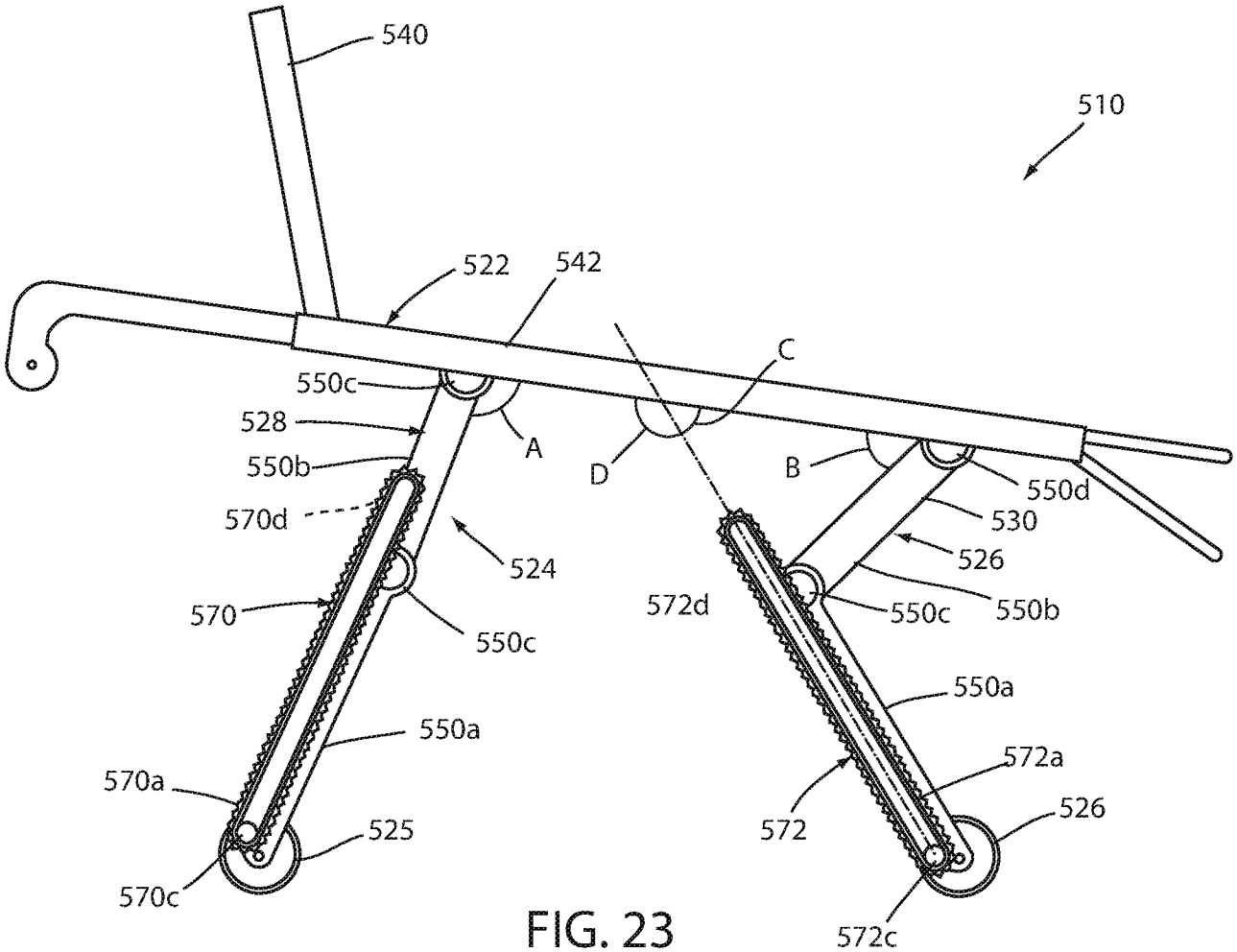
FIG. 23 is a side elevation view of the person handling apparatus of FIG. 22 shown in a raised but tilted configuration.
Figure 24:
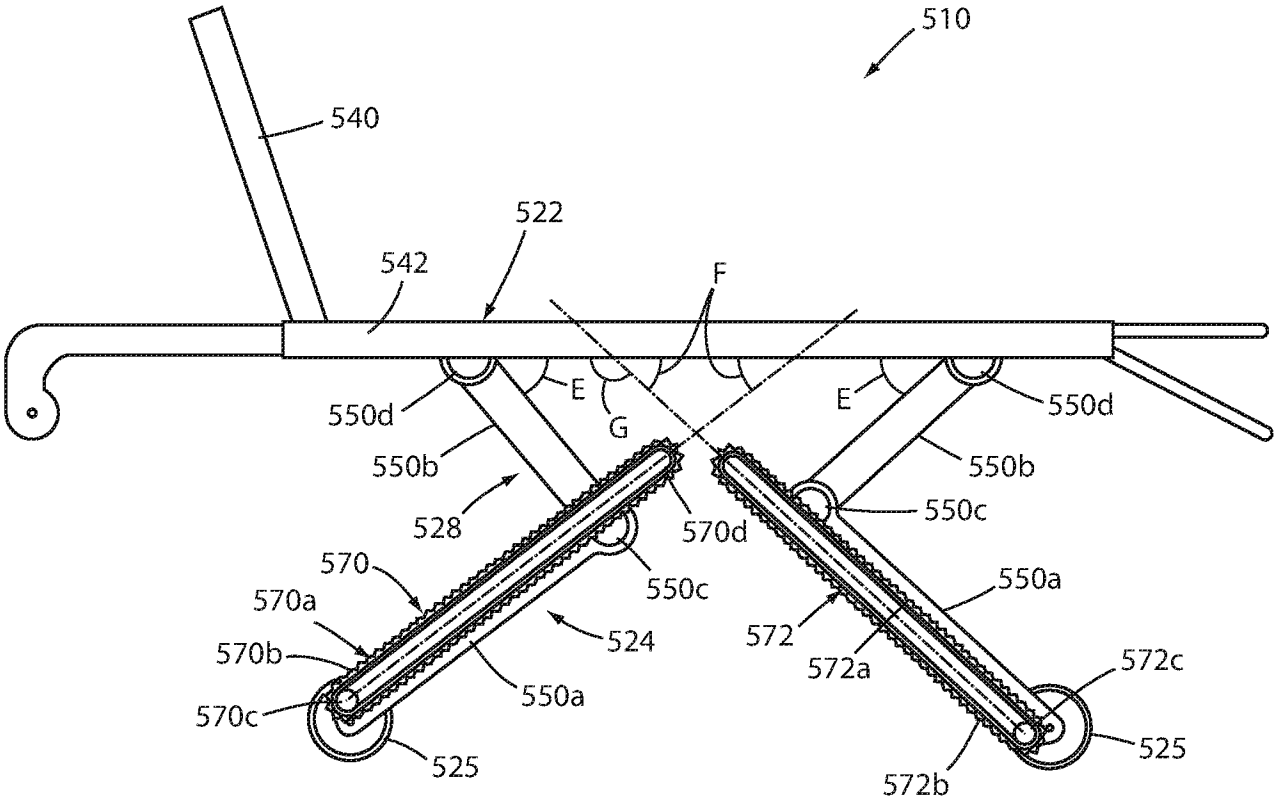
FIG. 24 is a side elevation view of the person handling apparatus of FIG. 22 shown in an intermediate raised or lowered configuration.

As best seen in FIGS. 22-24, each pair of track assemblies 570, 572 is mounted to head-end and foot-end wheeled leg assemblies 524, 526, respectively. In addition to supporting track assemblies 570, 572, each wheeled leg assembly 524, 526 supports or includes a pair of wheels 525, such as standard cot wheels, for a total of four wheels.

Figure 25:
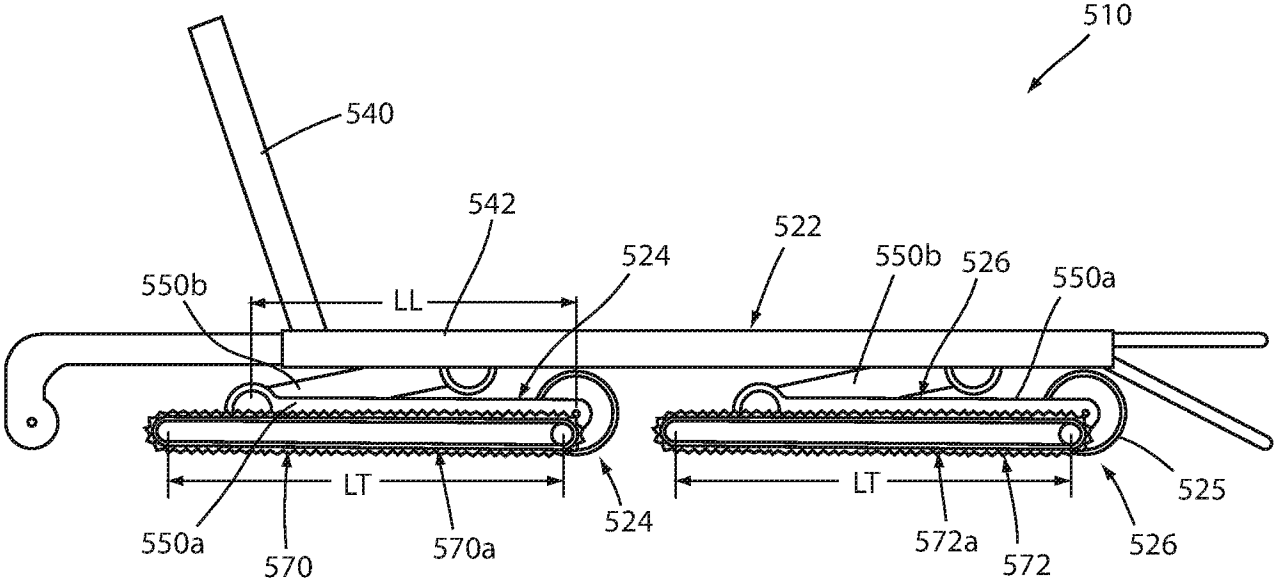
FIG. 25 is a side elevation view of the person handling apparatus of FIG. 22 shown in a fully lowered configuration.

In the illustrated embodiment, each pair of track assemblies 570, 572 may be mounted to its corresponding wheeled leg assembly 524, 526 in a fixed orientation, such as parallel and offset from the longitudinal axes 524*a*, 526*a* (FIG. 22) of its respective wheeled leg assembly and offset from the wheels' axes of rotation 525*a*. Further, each pair of track assemblies 570, 572 may be mounted offset sufficiently so that when the lower leg portions (described below) of their respective wheeled leg assemblies 524, 526 are rotated, track assemblies 570, 572 may engage the ground at the same time as the wheels 525 (as best seen in FIG. 25). For ease of reference, the continued description will be made in reference to each track assembly, with the understanding that the description can apply to both track assemblies in the respective pair of track assemblies.

Wheeled leg assemblies 524, 526 are each pivotally mounted to deck 522 and are movable such that deck 522 can be moved between a fully lowered position, such as shown in FIG. 25, and a raised position, such as shown in FIG. 22, as well as intermediate raised or lowered positions, such as shown in FIG. 24. Additionally, each leg assembly may be independently moved so that deck can be tilted, for example, moved to a raised and tilted position, such as shown in FIG. 23. As will be more fully understood in reference to FIG. 26, a tilted position for the deck 522 may be suitable to assist loading the person handling apparatus 510 into the rear opening of an emergency vehicle.

Figure 22A:
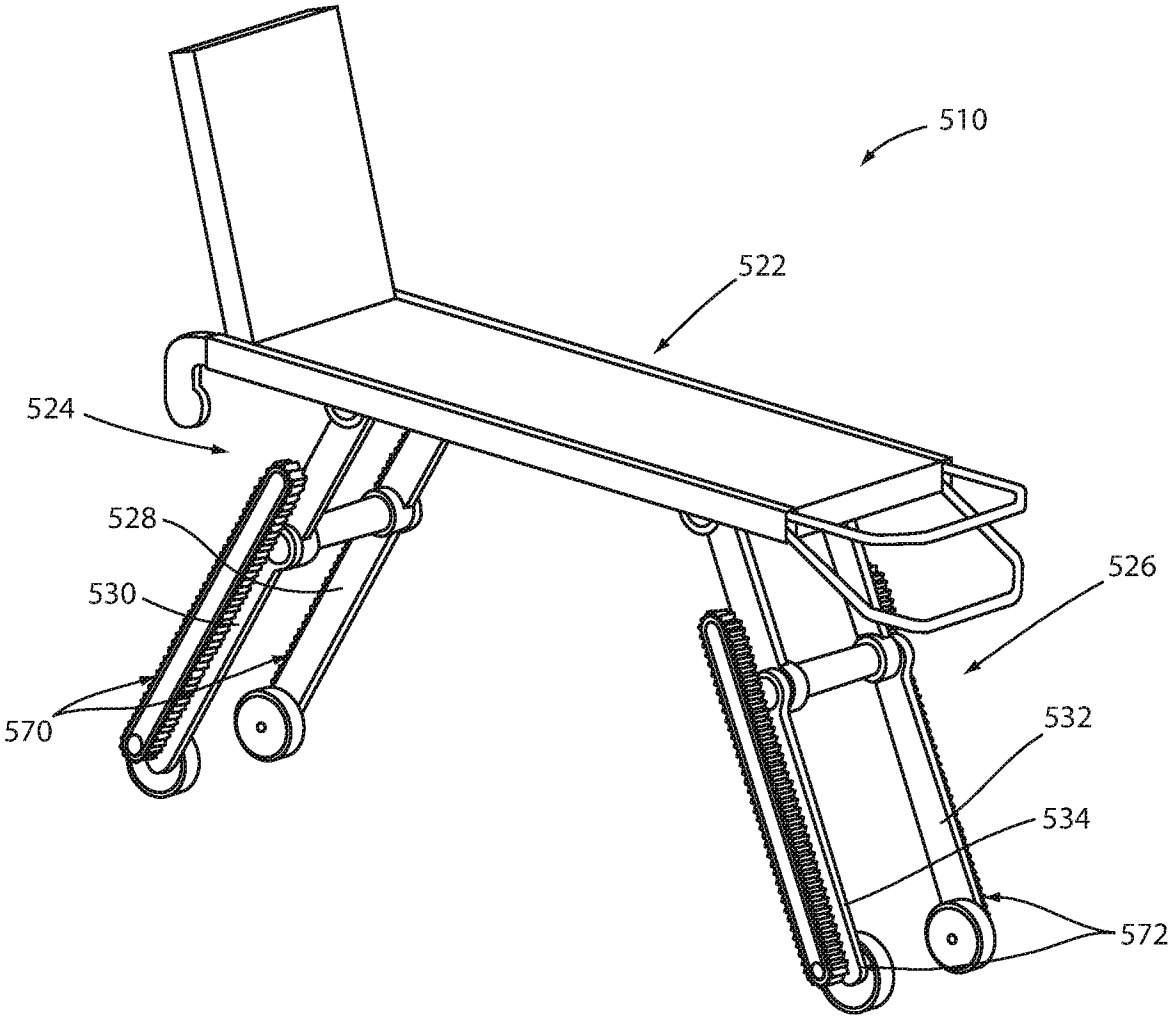
FIG. 22A is a perspective view of the person handling apparatus of FIG. 22.
Figure 22B:
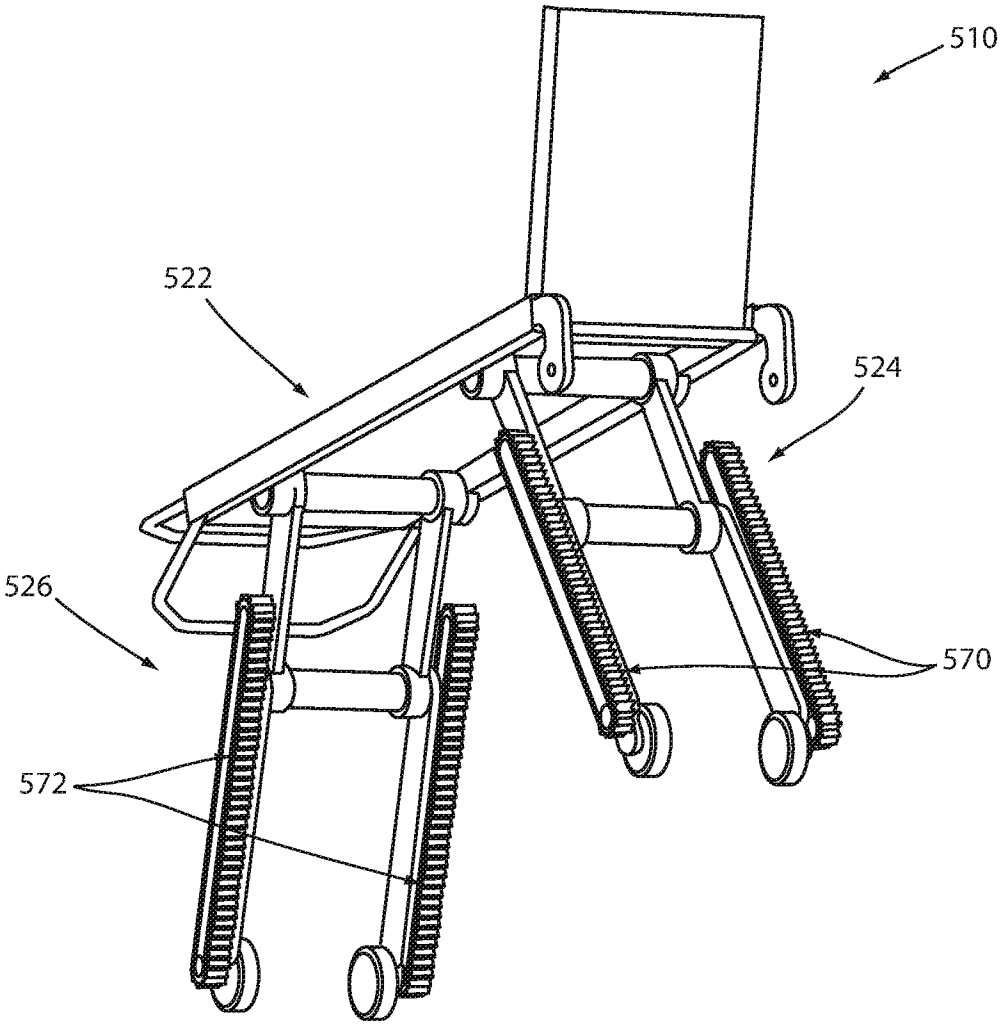
FIG. 22B is another perspective view of the person handling apparatus of FIG. 22.

In the illustrated embodiment, each wheeled leg assembly 524, 526 comprises a pair of legs 528, 530, 532, 534 (FIG. 22A and FIG. 22B), each with a wheeled lower leg portion 550*a* and an upper leg portion 550*b*. For example, each leg assembly 524, 526 may be formed from an inverted U-shaped frame with downwardly depending portions of the U-shaped frame forming the legs or formed from H-shaped frames, such as shown in FIGS. 22A and 22B, such as shown in reference to the previous embodiments, with the side frame members of the H-shaped frames forming the legs. Each wheeled lower leg portion 550*a* is pivotally mounted at or near the lower end of its respective upper leg portion 550*b* by a lower pivot connection 550*c*. Similarly, each upper leg portion 550*b* is pivotally mounted to the deck 522 by an upper pivot connection 550*d*. For example, the movement of each of the wheeled lower leg portions 550*a* about their upper leg portions 550*b* or of each upper leg portion 550*b* about their pivot connections 550*d* to deck 522 may be controlled by a mechanical connection that has defined positions (e.g. a connection that has spring biased detent mechanisms to define discrete locked positions requiring only a manual force to move the leg portions between their respective locked positions or with a manually operable release) or an actuator, such as a rotary actuator, including the rotary motors described above and in the referenced patents. It should be understood that both or one of the wheeled leg assemblies may comprise articulating wheeled leg assemblies, as noted above.

Referring again to FIG. 25, each track assembly 570, 572 has a track 570*a*, 572*a* with a longitudinal extent LT. Optionally, LT may be greater than the longitudinal extent LL that of its respective lower leg portion 550*a*. As described above, tracks 570*a*, 572*a* can be moved independently to engage surfaces with different orientations, such as the landing or floor at the top of a flight of stairs while also engaging and spanning two or three or more steps to enhance the stability of the person handling apparatus when descending or ascending stairs. Further with the split or bifurcated track arrangement, the center of gravity of the person handling apparatus may always extend through one of the tracks. Again this increases the stability and flexibility of the person handling apparatus when it is used to transport a person down or up a flight of stairs or in or out of an emergency vehicle.

In one embodiment, the track assembly or track assemblies are fixedly mounted to their respective lower leg portion and articulate with the lower leg portion. Alternately, the track assemblies may be mounted so that they articulate relative to the lower leg portions. For example, each track assembly 570, 572 may be pinned at one thereof, for example, at their lower ends, to their respective wheeled lower leg portion 550*b* and then coupled by a link (for example see link 98 shown in FIG. 12 and described above) to lower leg portion 550*b* to allow the track assemblies to pivot relative to their respective wheeled lower leg portion 550*b*. Further, the links may be configured to provide multiple discrete positions for the track assemblies.

In one embodiment, the track assemblies are mounted between the legs of the leg assemblies so that only a single track assembly is mounted to each leg assembly.

Optionally, one or each track assembly may be powered. As best understood from the various figures, especially FIG. 22, each track 570*a*, 572*a* is formed by a looped belt 570*b*, 572*b*, which are each mounted about a pair of spaced apart pulleys 570*c*, 570*d*. Each set of pulleys 570*c*, 570*d* may be mounted to a support, such as a plate, which together with the looped belt forms the track assembly. Optionally, the looped belts may be driven, as noted, by a driver, such as a motor, which can be controlled and powered by an onboard control and power supply. The motor may be mounted between the pulleys on, for example, the support that extends between and supports the two pulleys, or the motor may be integrated into one of the pulleys. Controls for the motor or motors that drive tracks 570*a*, 570*b*, as well as the rotary actuators that fold, unfold and/or pivot the legs of the leg assemblies 524, 526 described above, may be mounted on apparatus 510, for example, at the side or foot-end of deck, including on the handles 510*a* (FIG. 22) at the foot-end of apparatus 510. However it should be understood that the controls may be mounted at any location on apparatus 510 or even at a remote location, for example, a hand-held control device. The controls may be push button or switches, for example, or a touch screen with icons, for controlling the functions of the various electrically powered devices mounted on apparatus 510. For a more detailed description of suitable track assemblies, tracks, drivers, or looped belts, reference is made to U.S. Pat. No. 9,004,204, entitled MOTORIZED SLED FOR STAIR CHAIRS, U.S. Pat. Appl. 62/439,379 filed Dec. 27, 2016 entitled VARIABLE SPEED PATIENT TRANSFER DEVICE; 62/441,026 filed Dec. 30, 2016 entitled PATIENT TRANSFER APPARATUS and 62/440,167 filed Dec. 29, 2016 entitled PATIENT TRANSFER APPARATUS WITH INTEGRATED TRACKS, all commonly owned by Stryker Corporation of Kalamazoo, Mich., which are incorporated herein by reference in their entireties. For more details of suitable cots and components that may be included or mounted to the apparatus, reference is made to U.S. Pat. Nos. 5,537,700; 6,125,485; 6,276,010; 6,735,794; 7,100,224; 7,398,571; 7,478,855; 7,887,113; 8,439,416; and WO 2004/064698, for example, all commonly assigned to Stryker Corporation of Kalamazoo, Mich., which are incorporated by reference in their entireties herein.

In the illustrated embodiment, wheeled leg assemblies 524, 526 are pivotally mounted to the deck to move between folded, stowed positions and deployed positions. In the folded, stowed positions, the lower leg portions 550*a* generally lie in a common plane and the upper leg portions are folded under the deck 522 to lower the deck to its fully lowered or lowermost position. In the fully lowered position, the tracks or track assemblies lie in a common plane parallel to at least a portion of the deck (e.g. the seat portion) as best seen in FIG. 25. In this configuration, the tracks may be used to engage the floor and, further, can be used to drive the apparatus across a floor surface, as described below.

In one of the deployed positions, the upper leg portions and lower leg portions of each leg of the leg assemblies are aligned along a common axis (524*a*, 526*a*) and optionally angled at acute angle with respect to deck 22. Optionally, the leg assemblies 524, 526 may be moved or pivoted so that they are orthogonal to the deck 22 to maximize the height of the deck 22 of the apparatus 510 and move the deck 22 to a fully raised position.

Figure 26:
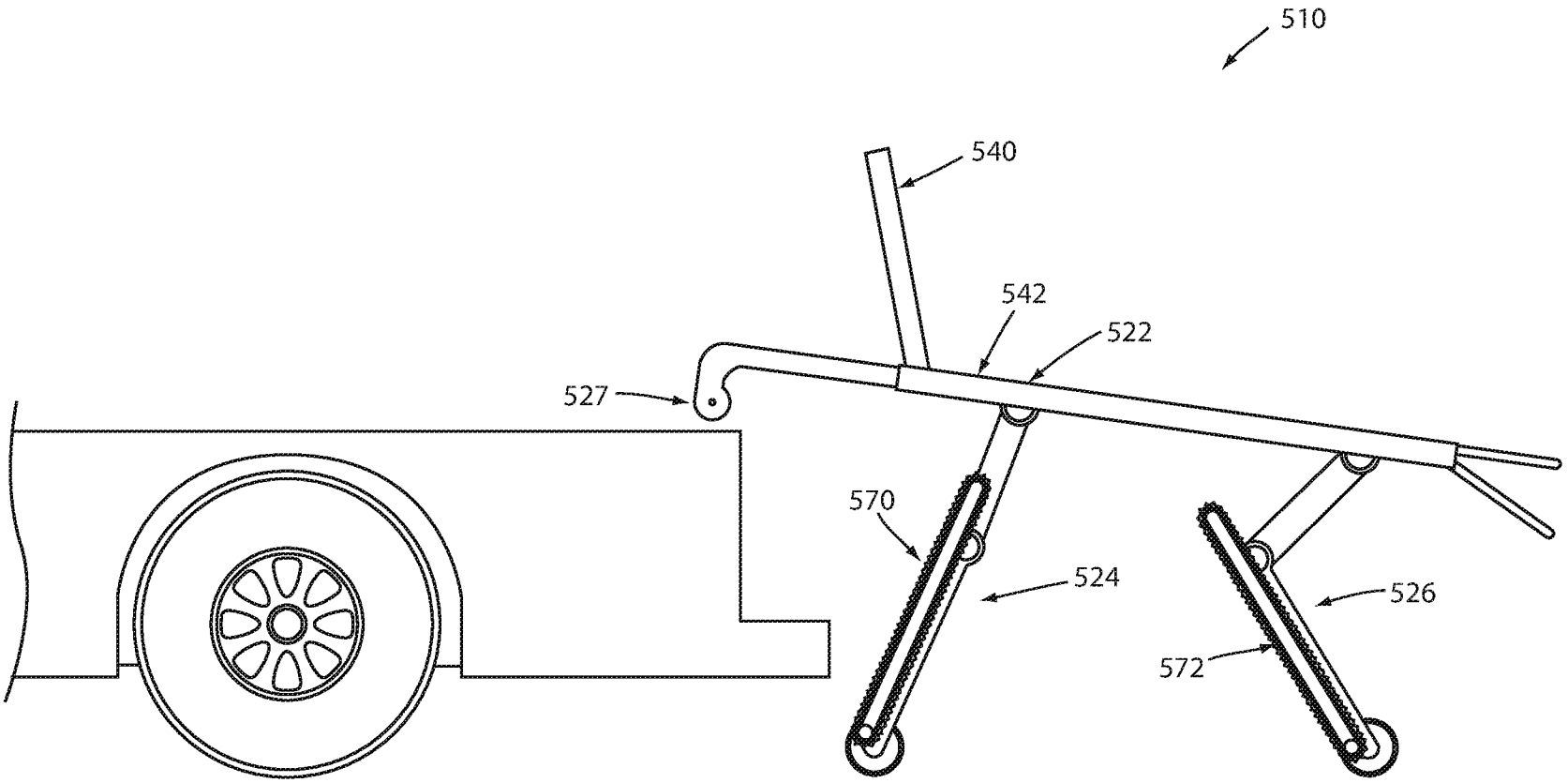
FIG. 26 is a side elevation view of the person handling apparatus shown in its raised but tilted configuration with the head-end loading wheel inserted into the rear compartment of an emergency vehicle.
Figure 26A:
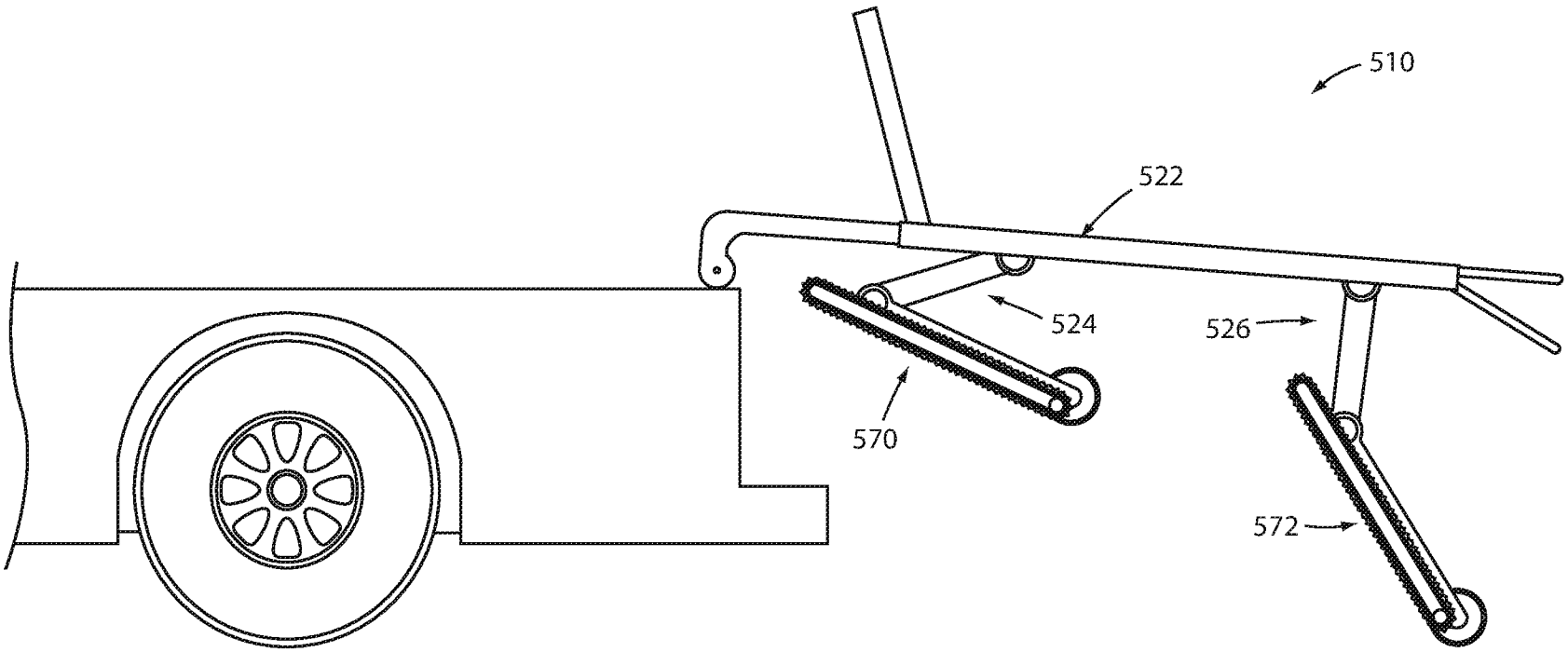
FIG. 26A is a similar view to FIG. 26 of the person handling apparatus shown with the head-end leg assemblies folding for insertion into the rear compartment of the emergency vehicle.

In another configuration, shown in FIG. 23, one pair of legs, such as the head-end legs 528, 530 (as shown in FIG. 22) are moved and extended (i.e. the upper leg portions and lower leg portions of the head-end leg are aligned along a common axis (524*a*)) to the same or similar deployed position as shown in FIG. 22. The foot-end legs 532, 534 instead are folded about their lower pivot connection 550*c* so that their upper leg portions 550*b* each form an acute angle B relative to deck 522 and their lower leg portions 550*a* (and their respective tracks or track assemblies) are angled at an acute angle C (or obtuse angle D) relative to the deck 522 to thereby tilt the deck, which can ease loading of person handling apparatus into the rear opening of an emergency vehicle, such as shown in FIG. 26.

In yet another deployed position, such as shown in FIG. 24, each leg assembly is moved to an intermediate deployed position where each leg 528, 530, 532, 534 is folded. For example, each leg 528, 530, 532, 534 may be folded so that their upper leg portions 550*b* each form an acute angle E relative to deck 522 and their lower leg portions 550*a* (and their respective tracks or track assemblies) are pivoted relative to their upper leg portions and are angled to form an acute angle F (or obtuse angle G) relative to the deck 522 to thereby raise or lower the deck to an intermediate height (i.e., a height between its raised position (e.g. FIG. 22) and fully lowered position (FIG. 25)). It should be understood that the angular orientation shown in FIGS. 22, 23, and 24 are exemplary and that the leg assemblies may be moved to other intermediate deployed positions. Further, as shown in FIGS. 23, 24, and 26, each leg assembly may be moved to a different deployed position than the other leg assembly.

In this manner, first and second pairs of track assemblies 570, 572 of person handling apparatus 510 are mounted relative to the deck independently of each other pair of track assemblies. Consequently, at least one pair of track assemblies can be independently positioned to engage a surface while the leg assembly supporting the other track assembly can support the other end of the person handling apparatus or so that each pair of track assemblies can be independently positioned to engage surfaces having different orientations. As described, when person handling apparatus 510 is used to transport a person down a flight or set of stairs, such as shown in FIGS. 30-34, one (e.g. the head-end) track assembly 570 (or pair of track assemblies) may engage the floor at the top of the stairs, while the other (e.g. foot-end) track assembly (or pair of track assemblies) may be positioned to engage the steps of the stairs. Similarly, while one pair of track assemblies is deployed to engage a surface (such as the floor of an emergency vehicle (FIG. 28) or stairs (FIGS. 32-33)) the other pair of track assemblies may be moved to a folded, stowed or non-deployed position, and instead support the deck on the wheel of its leg assembly.

Figure 27A:
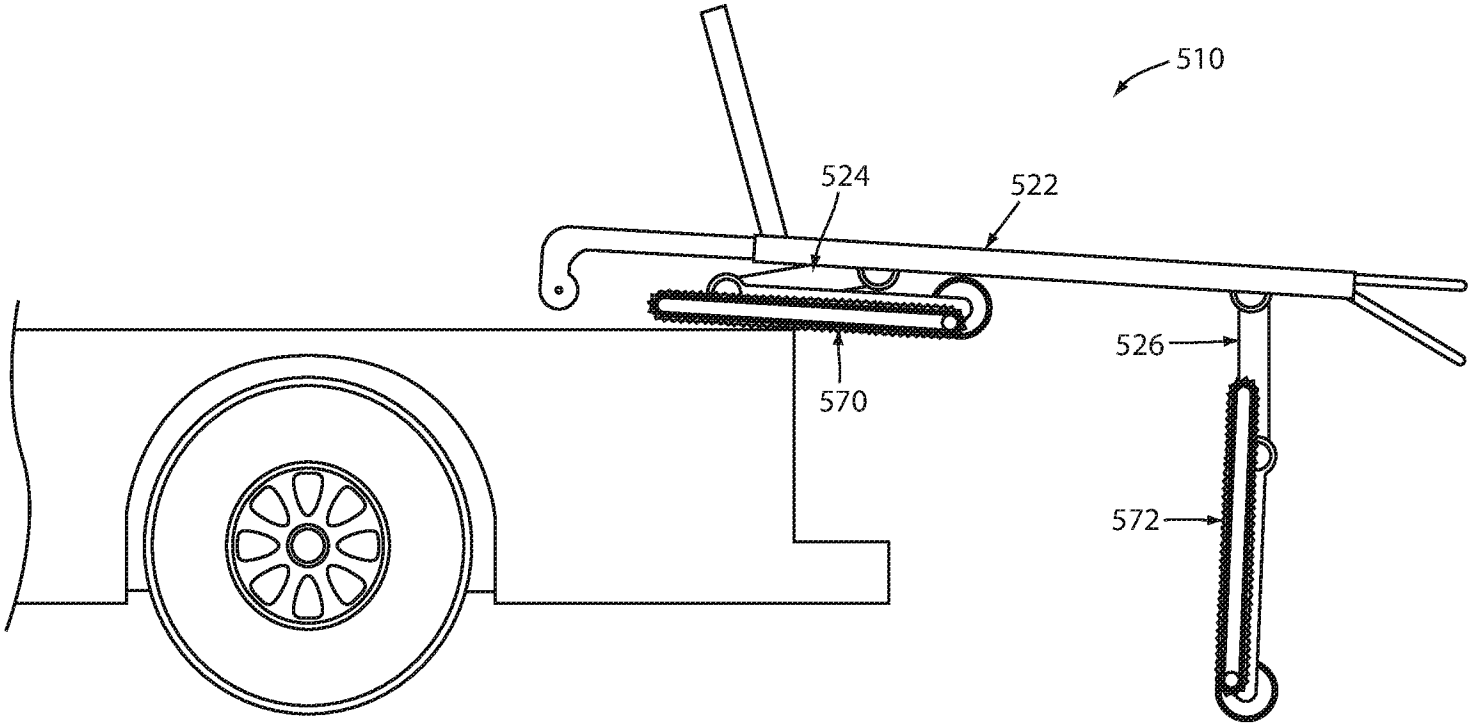
FIG. 27A is a similar view to FIG. 27 illustrating the head-end leg assembly and track fully folded and engaged with the floor of the emergency vehicle and the foot-end leg assembly fully extended to raise the foot-end of the deck to its fully raised height.

The independent control of the leg assemblies allows the person handling apparatus 510 to be reconfigured into a variety of different configurations. As illustrated in FIG. 26, tilting the deck 522 upwardly at the head-end may better position apparatus 510 for insertion into an emergency vehicle, for example, when the emergency vehicle has a higher compartment. Once the head-end deck wheels 527 are supported on the floor of the compartment, the head-end leg assembly 524 and track assemblies 570 can be folded (FIG. 27) so that tracks 570*a* of the head-end leg assembly may be powered to assist in pulling person handling apparatus 510 into the emergency vehicle while still being supported by the foot-end leg assembly 526. Further, referring again to FIG. 27, the foot-end leg assembly 526 may be extended and pivoted to raise the foot-end of deck 522 so that deck 522 can remain substantially level or horizontal when being loaded into the emergency vehicle. Optionally, depending on the height of the emergency vehicle, the foot-end leg assembly 526 may be fully extended and pivoted where it is generally perpendicular to the deck 522, such as shown in FIG. 27A, to raise the foot-end of deck 522 so that deck 522 is in its fully raised position so that it can remain substantially level or horizontal when being loaded into the emergency vehicle the deck 522. Alternately, when the height of the emergency vehicle compartment permits, the deck 522 not need not be tilted—and instead may remain horizontal and inserted from the raised position, such as shown in FIG. 27, and in some cases from an intermediate raised position where both the leg assemblies are folded.

Figure 29:
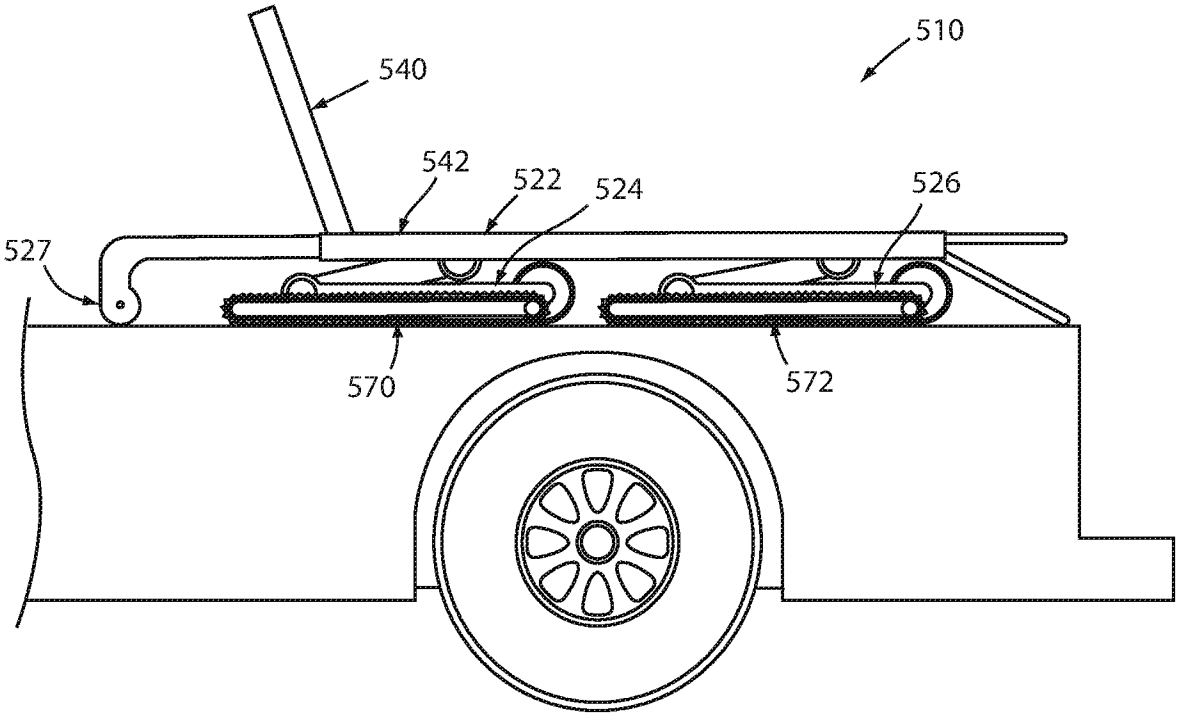
FIG. 29 is a similar view to FIG. 28 illustrating the person handling apparatus fully inserted into the rear compartment of an emergency vehicle.

Once person handling apparatus 510 is sufficiently inserted into the emergency vehicle, for example, when the deck wheels 527 are on the emergency vehicle compartment floor and the center of gravity is within the compartment of the emergency vehicle (for example as shown in FIG. 28), then an operator while supporting the foot-end of the apparatus 10 can fold the foot-end leg assemblies 526 so that their track assemblies 572 may also engage the floor of the emergency vehicle and used to assist track assemblies 570 in pulling person handling apparatus 510 into the emergency vehicle (FIG. 29).

As noted above, this flexible split or bifurcated track configuration also allows the track assemblies of person handling apparatus 510 to be independently positioned to engage different surfaces with different orientations. With reference to FIGS. 30-34, when person handling apparatus 510 is moved to the top of a flight of stairs, apparatus 510 can be first lowered down to its lowermost position where both track assemblies 570, 572 engage the floor at the floor at the top of the stairs.

Once lowered, the foot-end of the deck 522 can be moved (e.g. by driving tracks 570*a*, 572*a*) to extend over the top step, and thereafter the foot-end leg assembly 526 can be unfolded so that its track assemblies 572 can be oriented or positioned to engage and straddle two or more steps (FIG. 30). In this orientation, the center of gravity still remains on top of the stairs, and optionally still passes through the head-end track assemblies 570.

When the deck 522 of the person handling apparatus 510 and the head-end track assemblies 570 are moved to beyond the top step (FIG. 31), the head-end leg assembly 526 can thereafter be unfolded (FIG. 31A) to allow track assembly 572 to engage the steps of the stairs. In this configuration, the center of gravity still remains on top of the stairs, and optionally remains passing though head-end track assemblies 570. Also, during the transition, the foot-end track assemblies may momentarily disengage from the steps (FIG. 31). However, as the person handling apparatus 510 extends over the top step (FIG. 31A), the foot-end track assemblies 572 can be further unfolded and/or tilted to re-engage or maintain engagement with the steps until the head-end track assemblies straddle two or more steps, such as shown in FIG. 31B. Optionally, at this time the center of gravity may still remain extending through the head-end track assemblies. As the person handling apparatus 510 continues to descend, and as shown in FIGS. 32 and 32A, the foot-end leg assemblies 526 may be gradually fully unfolded so that their track assemblies 572 disengage from the steps, and instead their wheels can engage the floor at the bottom of the stairs (FIG. 32A). For a shorter set of stairs, only one of the track assemblies 570 or 572 may be engaged with the steps.

As best understood from FIGS. 33 and 34, in either situation, once the head-end track assembly 570 is near to the last step and its wheels can engage the floor, head-end wheeled leg assembly 524 will be unfolded so that once again both pairs of wheels are engaged with the floor. In one embodiment, both pairs of leg assemblies 524, 526 are moved to their extended positions when apparatus 510 approaches the end of the stairs. However, it should be understood that one or both leg assemblies 524 or 526 may remain in an intermediate deployed position (e.g. leg assemblies 524, 526 are folded) when transitioning from the stairs to the floor or ground level (or vice versa). It should be understood that when used to transport or load a patient into an emergency vehicle, apparatus 510 can be operated with the leg assemblies 524, 526 in all of the different configurations and any combination thereof.

It should be understood the folding and unfolding of the leg assemblies 524, 526, as described above, may be achieved as described above by actuators, such as motors, and controlled by a user using an onboard controller, such the controls described above. Further, apparatus 510 may include one or more sensors that sense the presence or absence of a load on the wheels or proximity to stairs or an emergency vehicle, such as described in copending application entitled PATIENT SUPPORT, U.S. patent Ser. No. 14/998,028, filed on Jul. 7, 2014 (STR03E P-433), which is incorporated by reference in its entirety herein, and generate input signals to the onboard controller, with the controller controlling and driving the various actuators, such as motors, based on the input signals from the sensor or sensors to move the leg assemblies and track assemblies as described to suit the sensed conditions. Further, the controller may be configured to override an input signal from a user based control at the apparatus when the user based signals conflict with the condition or condition sensed by the sensors.

Additionally, although some specific examples of actuators have been noted herein, such motors, electric cylinders, pneumatic cylinders, mechanical, actuators, and hydraulic cylinders, the actuators may be any type of pneumatic, electric, hydraulic or mechanical actuator and may or may not have a gear or motor.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

We claim:

1. A person handling apparatus comprising:

a deck having a seat section, a leg section, and a back section, said back section being pivotally mounted to said seat section, said leg section having a proximal end pivotally mounted to said seat section and a cantilevered distal end spaced from said proximal end, and said seat section, said leg section, and said back section operable to align to define a supine configuration for said deck to support a person in a supine position and to pivot to define a chair configuration for said deck to support a person in a seated position; and first and second leg assemblies pivotally mounted to said deck for supporting said deck on a support surface, with at least one of the first and second leg assemblies being pivotally mounted to the back section of said deck with a pivot connection wherein said pivot connection moves with said back section when said back section pivots, said first and second leg assemblies configured to move between (1) first deployed positions wherein said first and second leg assemblies are angled relative to said deck when said deck is in said supine configuration wherein said leg assemblies support said deck in a cot position relative to said support surface and (2) second deployed positions wherein said leg assemblies support said deck in said chair configuration relative to said support surface.

2. The person handling apparatus according to claim 1, wherein each respective leg assembly of said first and second leg assemblies includes an actuator to pivot said respective leg assembly.

3. The person handling apparatus according to claim 1, wherein said first leg assembly includes at least one wheel.

4. The person handling apparatus according to claim 3, wherein said at least one wheel of said first leg assembly comprises a caster wheel assembly, said caster wheel assembly including a caster wheel with a swivel axis and being configured to maintain said swivel axis in an orthogonal orientation to the ground surface on which the person handling apparatus is supported.

5. The person handling apparatus according to claim 4, wherein said first leg assembly includes two caster wheel assemblies, each caster wheel assembly having a caster wheel rotatable about its respective swivel axis, and rotation of said caster wheels about their respective swivel axes is coupled together to maintain their orientations relative to each other.

6. The person handling apparatus according to claim 1, wherein said first leg assembly comprises an articulatable leg assembly and is pivotally mounted to said seat section at a first pivot connection, and said articulatable leg assembly including a hinge spaced from said first pivot connection wherein said first leg assembly is foldable about said hinge.

7. The person handling apparatus according to claim 6, wherein said seat section has a seat section length, said first leg assembly having an upper portion above said hinge and a lower portion below said hinge, said hinge being spaced from said first pivot connection a distance approximately equal to said seat section length wherein when said first leg assembly is folded about said hinge said upper portion of said first leg assembly is positionable to extend alongside said seat section and said lower portion of said first leg assembly is positionable to extend alongside said leg section to define said second deployed position when deck is folded into said chair configuration.

8. The person handling apparatus according to claim 7, wherein said leg section of said deck has a leg section length, said lower portion of said first leg assembly having a lower portion length approximately equal to or greater than said leg section length wherein when said first leg assembly is moved to said second deployed position said leg section of said deck may be moved to a vertical orientation without interfering with the floor or ground surface.

9. The person handling apparatus according to claim 6, wherein said first leg assembly includes a first pivot connection actuator, said first pivot connection actuator to pivot said first leg assembly about said first pivot connection.

10. The person handling apparatus according to claim 9, wherein said first pivot connection actuator comprises an actuator selected from the group consisting of an electric actuator, a pneumatic actuator, a hydraulic actuator, and a manual mechanical actuator.

11. The person handling apparatus according to claim 6, wherein said first leg assembly includes a hinge actuator at said hinge to fold said first leg assembly about said hinge.

12. The person handling apparatus according to claim 11, wherein said hinge actuator comprises a motor and gear.

13. The person handling apparatus according to claim 1, wherein said pivot connection comprises a translatable pivot connection.

14. The person handling apparatus according to claim 13, wherein said second leg assembly includes a translatable pivot connection actuator, said translatable pivot connection actuator to pivot said second leg assembly about said translatable pivot connection.

15. The person handling apparatus according to claim 14, wherein said translatable pivot connection actuator comprises a motor and gear.

16. The person handling apparatus according to claim 1, wherein said second leg assembly includes a stair climbing track.

17. The person handling apparatus according to claim 16, wherein said stair climbing track comprises a powered stair climbing track.

18. The person handling apparatus according to claim 16, wherein said stair climbing track is pivotally mounted to said second leg assembly wherein said stair climbing track can be moved from a deployed position to a stowed position.

19. The person handling apparatus according to claim 16, wherein said stair climbing track has a length sufficient to span three steps of a stairway.

20. The person handling apparatus according to claim 1, further comprising a back actuator to pivot said back section relative to said seat section.

21. The person handling apparatus according to claim 20, wherein said back actuator comprises a motor and gear.

22. The person handling apparatus according to claim 1, further comprising a leg actuator to pivot said leg section relative to said seat section.

23. The person handling apparatus according to claim 22, wherein said leg actuator comprises a motor and gear.

24. The person handling apparatus according to claim 1, wherein said first and second leg assemblies are pivotally mounted to said deck to further move to folded, stowed positions wherein said first and second leg assemblies generally lie in a common plane with said deck, when said deck is in said supine configuration.

25. The person handling apparatus according to claim 1, wherein said first and second leg assemblies are configured to support said deck at a cot height when said deck is in said supine configuration and said first and second leg assemblies are moved to their first deployed positions and to support said deck at a chair height when said first and second leg assemblies are moved to their second deployed positions and said deck is in said chair configuration.

* * * * *